United States Patent [19]

Kobayashi et al.

[11] Patent Number: 4,898,807

[45] Date of Patent: Feb. 6, 1990

[54] METHOD FOR FORMING DIRECT POSITIVE COLOR IMAGE USING AN N-HYDROXY ALKYL-SUBSTITUTED-P-PHENYLDIAMINE DERIVATIVE AT ELEVATED TEMPERATURES FOR A SHORT PERIOD OF TIME

[75] Inventors: Kazuhiro Kobayashi; Shigeharu Koboshi; Kazuyoshi Miyaoka, all of Hino, Japan

[73] Assignee: Konishiroku Photo Industry Co., Ltd., Tokyo, Japan

[21] Appl. No.: 348,095

[22] Filed: May 1, 1989

Related U.S. Application Data

[63] Continuation of Ser. No. 68,719, Jun. 29, 1987, abandoned, which is a continuation-in-part of Ser. No. 868,288, May 28, 1986, abandoned.

[30] Foreign Application Priority Data

| | | | |
|---|---|---|---|
| May 31, 1985 | [JP] | Japan | 60-118443 |
| Jun. 18, 1985 | [JP] | Japan | 60-132649 |
| Jul. 12, 1985 | [JP] | Japan | 60-153699 |

[51] Int. Cl.[4] ..... G03C 7/16

[52] U.S. Cl. ..... 430/378; 430/435; 430/467; 430/547; 430/596; 430/940

[58] Field of Search ..... 430/435, 378, 467, 547, 430/596, 940

[56] References Cited

U.S. PATENT DOCUMENTS

| | | | |
|---|---|---|---|
| 3,335,004 | 6/1967 | Wrisley et al. . | |
| 3,719,492 | 3/1973 | Barr et al. | 430/383 X |
| 3,761,266 | 9/1973 | Milton et al. | 430/591 X |
| 3,761,276 | 9/1973 | Evans et al. | 430/547 X |
| 4,322,492 | 3/1982 | Kunitz et al. | 430/467 X |
| 4,433,050 | 2/1984 | Abe et al. | 430/547 X |
| 4,440,851 | 4/1984 | Tosaka et al. | 430/378 |
| 4,444,871 | 4/1984 | Miyaoka et al. | 430/378 |
| 4,613,563 | 9/1986 | Murai | 430/940 X |

FOREIGN PATENT DOCUMENTS

| | | |
|---|---|---|
| 0089101 | 9/1983 | European Pat. Off. . |
| 1151363 | 5/1969 | United Kingdom . |

OTHER PUBLICATIONS

Chem. Abstracts, vol. 8, No. 4.

H. Bottcher et al., "Modern Photographische Systeme", 1st ed., 1983, pp. 142–159.

T. H. James, "Theory of the Photographic Process", 4th Ed., 1977, pp. 408–411, 426–428.

*Primary Examiner*—Paul R. Michl

*Assistant Examiner*—Janet C. Baxter

*Attorney, Agent, or Firm*—Frishauf, Holtz, Goodman & Woodward

[57] ABSTRACT

A method for forming a direct positive color image by subjecting an inner latent image type light-sensitive silver halide color photographic material for formation of a direct positive color image, having at least one light-sensitive emulsion layer containing inner latent image type silver halide grains which have not been previously fogged on the grain surfaces to color developing processing after image exposure, which comprises developing an inner latent image type light-sensitive silver halide color photographic material for formation of a direct positive color image wherein a silver halide emulsion in at least one light-sensitive emulsion layer consists substantially of a silver chlorobromide emulsion with the use of a color developing solution containing an N-hydroxyalkyl-substituted-p-phenylenediamine derivative at 30° C. or higher for not longer than 150 seconds.

In accordance with the present invention, there can be provided a rapid and stable method of processing an inner latent image type light-sensitive material for formation of direct positive image by use of a color developer containing the color developing agent of the present invention, which can maintain constantly adequate photographic performance over a long term without suffering from influence by the change in the bromide ion concentration even when processed when reduced supplemental amount and is also little in generation of developing fog.

22 Claims, 1 Drawing Sheet

METHOD FOR FORMING DIRECT POSITIVE COLOR IMAGE USING AN N-HYDROXY ALKYL-SUBSTITUTED-P-PHENYLDIAMINE DERIVATIVE AT ELEVATED TEMPERATURES FOR A SHORT PERIOD OF TIME

This application is a continuation of application Ser. No. 07/068,719, filed June 29, 1987; abandoned which is a CIP of Ser. No. 06/868,288 filed May 28, 1986(Abandoned).

BACKGROUND OF THE INVENTION

This invention relates to a method for forming a positive color image by use of an inner latent image type light-sensitive silver halide color photographic material for formation of direct positive color image, more particularly to novel processing method which is little in dependence on the concentration change in bromide ion caused by the change in amount replenished and the influence by evaporation and also in dependence on processing time and yet is not impaired in rapidity, and also small in developing fog, especially a processing method with small amount to be replenished and high processing stability.

Methods for obtaining direct positive images known in the prior art can be classified mainly into the two types. One type employs a silver halide emulsion having previously fogged nucleus and positive image is obtained after development by destroying the fogged nucleus or the latent image at the exposed portion by utilizing solarization or Hershel effect, etc. The other type employs an inner latent image type silver halide emulsion not previously subjected to fogging, fogging treatment (treatment for forming developing nucleus) is applied after image exposure and then surface development is performed or alternatively surface treatment is performed while applying fogging treatment (treatment for forming developing nucleus) after image exposure, whereby a positive image can be obtained.

The above fogging treatment (treatment for forming developing nucleus) may be conducted by way of giving the whole surface exposure, chemically by use of a fogging agent, or by use of a strong developing solution, or further by heat treatment, etc.

Of the above two methods for formation of positive images, the methods of the latter type are generally higher in sensitivity than the methods of the former type and therefore suitable for uses in which high sensitivity is required.

In this field of the art, various techniques have been hitherto known. For example, there have been known the methods disclosed in U.S. Pat. Nos. 2,592,250, 2,466,957, 2,497,875, 2,588,982, 3,761,266, 3,761,276 and 3,796,577 and U.K. Pat. No. 1,151,363.

In the case of processing of an inner latent image type light-sensitive silver halide color photographic material (hereinafter referred to as inner latent image type light-sensitive material), the process comprises basically the two steps of color development and desilverization which are performed after application of the fogging treatment and/or while applying fogging treatment, desilverization comprising bleaching and fixing steps or bleach-fixing step. Otherwise, as additive processing steps, rinsing processing, stabilizing processing, etc., are added.

In the color development performed after application of fogging treatment and/or while applying fogging treatment, the silver halide at the unexposed portion is reduced to silver, and at the same time the oxidized aromatic primary amine developing agent reacts with a coupler to form a dye. In this process, the halide ions formed by reduction of silver halide are dissolved out into the developing solution to be accumulated therein. Separately, the components such as inhibitors contained in the inner latent image type light-sensitive material are dissolved in the color developing solution to be accumulated therein. In the desilverization step, the silver formed by development is bleached with an oxidizing agent and then all the silver salts are removed from within the inner latent image light-sensitive material as soluble silver salts with a fixing agent. It is also known to perform one bath bleach-fixing processing method, in which the bleaching step and the fixing step are carried out at the same time.

In the color developing solution, developing inhibiting substances are accumulated by developing processing of the inner latent image type light-sensitive material as described above. On the other hand, the color developing agent or benzyl alcohol are consumed or brought out as accumulated within the inner latent image type light-sensitive materials, and the concentrations of those components become lowered. Accordingly, in the developing processing method in which a large amount of inner latent image type light-sensitive materials are continuously processed by means of an automatic developing machine, etc., it is necessary to have a means for maintaining the components of the color developing solution within the constant levels in order to avoid changes in characteristic after finishing of development due to the changes in component concentration. As such a means, it has been generally employed to replenish the components in shortage and replenishing a replenisher for diluting unnecessary increased components. Due to replenishing of such a replenisher, a large amount of overflow of the solution is necessarily formed and discarded, and therefore this method involves great problems in economy and environmental pollution. For this reason, in recent years, in order to reduce the above overflow solution there has been proposed and practically employed the so-called low flow replenishment system in which these replenishers are concentrated and replenished in a small amount.

However, if the amount replenished is extremely reduced, the organic inhibitors or halide ion concentration dissolved out into the developing solution will suffer from great concentration changes even by slight errors in the amount replenished and will be susceptible to the influence by concentration through evaporation whereby the above spent accumulated products are generally increased in concentration. For example, by increase of halide ion concentration, the developing reaction is inhibited, particularly more inhibited at the higher density portion of the characteristic curve, whereby there ensues the problem such that no satisfactory density can be obtained even by elongation of the processing time. For avoiding this, for example, one may consider to remove the halide ions by ion exchange resin or electrodialisis from the overflow solution and use it as the replenisher again by regeneration with addition of a regenarating agent for replenishing the defficient components which became in shortage during development or lost during regeneration treatment, as proposed in processing of the surface latent image type light-sensitive silver halide color photographic material (hereinafter referred to as surface latent image type light-sensitive material) for formation of negative image.

According to these regeneration by ion exchange resin or electrodialisis and the thickened reduced replenish system, processing is affected by evaporation or regeneration operation, and also susceptible to the change in bromide ion concentration, and also affected by the difference in the amount processed as well as the difference in the amount of replenishers, whereby there is involved the drawback that the processing solutions differ in composition to a great extent.

For such reasons, in the low flow replenishment processing or the regeneration method, it is necessary to make efforts to quantitate the components for every cycle of regeneration to maintain the composition at a constant level, and therefore these regeneration processing and low flow replenishment processing can be practiced with difficulty in a developing station or mini-laboratory, etc., having no special skill.

Such problems are caused primarily by the change in bromide ion which is the developing inhibitor. For example, the problem may be estimated to be solved by improving the developing characteristic by making smaller the mean grain size of the silver halide in the inner latent image type light-sensitive material. However, in a color developing solution using 3-methyl-4-amino-N-ethyl-N-β-methanesulfoneamidoethylaniline which is the developing agent of the prior art, if the developing characteristic is improved, processing will become rather more susceptible to the change in bromide ion concentration in the developing solution to result impairment of processing stability as contrary to the expected result.

However, it is an important task to enhance processing stability simultaneously with shortening of the processing time. That is, the strong demand of the era is the above-mentioned low flow replenishment in the economical sense, but short time processing is also strongly demanded in aspect of shortening the time limit of delivery.

Whereas, as mentioned above, rapid processing and stabilization of processing or low flow replenishment are issues which are antagonistic to each other, which may be criticized as a relationship of trade-off.

That is, if low flow replenishment is aimed at, the concentration of the bromide ion which is the inhibiting substance or the concentration of a sulfur compound or a mercapto compound which is the emulsion stabilizer will be increased to impair rapidity, and processing stability is impaired.

Nevertheless, various countermeasures have been taken to expedite color development in the prior art. Particularly, since the above developing agent which have been used in the prior art as the most suitable developing agent for the silver chlorobromide emulsion of the inner latent image type is low in hydrophilic property, it can be slowly penetrated into the light-sensitive material, and therefore various penetrating agents for acceleration of penetration have been investigated. For example, there have been widely employed the method in which color development is accelerated by addition of benzyl alcohol into the color developing solution. However, according to this method no satisfactory color development can be effected unless processing is performed at 33° C. for 3 minutes or longer. Besides, there is also involved the drawback of being susceptible to the subtle influence by the bromide ion concentration. There is also known the method of increasing the pH of the color developing solution, but when the pH becomes 10.5 or higher, the color developing agent will be oxidized at a remarkably higher rate, changes in pH have great effect on processing due to absence of an appropriate buffer to give no stable photographic characteristic, and also dependency on the processing time becomes greater.

It is also known to increase the activity of the color developing solution by increasing the amount of the color developing agent contained therein. However, since the color developing agent is very expensive, the cost of the processing solution becomes higher and at the same time there is the problem of instability that the above agent is difficultly soluble in water and will be readily precipitated. Thus, this method is not useful in practical application.

On the other hand, for accomplishing a rapid color development of the surface latent image type light-sensitive material, it has been known to have the color developing agent previously built in the light-sensitive material. For example, there has been known the method in which the color developing agent is built in as a metal complex (U.S. Pat. No. 3,719,492). However, according to this method, the light-sensitive material is poor in raw storability, and drawbacks such as fogging before use and further tendency to be fogged during development are known to be involved.

Further, for inactivation of the amine portion of the color develping agent, there has been known the method, for example, in which the color developing agent is built in as Schiff salt (U.S. Pat. No. 3,342,559, Research Disclosure, No. 15159, 1976). However, according to these methods, color development cannot be initiated after alkali hydrolysis of the color developing agent (thus involving rather the drawback that color development is delayed).

Further, in the case of having a color developing agent directly built in, in addition to the drawback of fogging of the emulsion during storage due to instability of the color developing agent, various kinds of troubles are known to be generated in processing because the emulsion film quality becomes weaker.

It has been found that the same drawbacks are involved also in the case when the techniques known in the surface latent image type light-sensitive material as described above are applied for the inner latent image type light-sensitive material.

Also, as the accelerators known in the surface latent image type light-sensitive materials in the prior art, investigations have been made about the compounds disclosed in U.S. Pat. Nos. 2,950,970, 2,515,147, 2,496,903, 4,038,075 and 4,119,462; U.K. Pat. Nos. 1,430,998 and 1,455,413; Japanese Unexamined Patent Publications Nos. 15831/1978, 62450/1980, 62451/1980, 62452/1980 and 62453/1980; Japanese Patent Publications Nos. 12322/1976 and 49728/1980; etc. As the result, most of the compounds have insufficient acceleration effect on the inner latent image type light-sensitive materials, and the compounds having high acceleration effect not only have the drawback of forming developing fog but also unsuitable for improvement of processing stability.

It is also known to accelerate development by providing a silver halide emulsion layer which is substantially non-light-sensitive in a surface latent image type light-sensitive material as disclosed in Japanese Unexamined Patent Publications Nos. 23225/1975, 14236/1981; U.K.

Pat. No. 1,378,577, German Laid-open Patent Publication No. (OLS) 26 22 922; etc., but its function is to absorb unnecessary halogens released during development and developing inhibiting substances such as unnecessary eliminated groups of DIR couplers or DAR couplers, and it is not to accelerate positively development. Particularly, even when applied for an inner latent image type light-sensitive material, its development accelerating effect is not only small, but no processing stabilizing effect can be obtained with respect to fluctuation in bromide ion concentration, although it may have an effect with respect to fluctuation in iodide ion concentration.

On the other hand, in the case of the surface latent image type light-sensitive material, the speed of color development is said to differ depending on the kind of the para-phenylenediamine derivative employed and depend on the redox potential. Of these color developing agents, N-alkyl substituted color developing agents having low water solubility such as N,N-diethyl-p-phenylenediamine sulfate or 3-methyl-4-amino-N,N-diethylaniline hydrochloride, while having high developing activity and enabling rapid processing, are known to be low in dark fading characteristic of the color formed dye after processing. When applied for the inner latent image type light-sensitive material, substantially similar results were obtained and no stability could be obtained with respect to the bromide ion concentration. On the other hand, when 3-methyl-4-amino-N-ethyl-N-β-methoxyethylaniline-di-toluenesulfonate which is said to be preferable with high developing activity in the surface latent image type light-sensitive material (see U.S. Pat. Nos. 3,656,950 and 3,658,525) is applied for the inner latent image type light-sensitive material, rapid processing can be surely effected but no stability with respect to the bromide ion concentration can be obtained and yellow stain was also found to be generated markedly in the unexposed portion of the inner latent image type light-sensitive material after processing. Particularly, when processed within a short time, the color developing solution remains to cause disadvantageously generation of coarse stains. Thus, this compound was found to be unuseful in rapid processing.

On the other hand, 3-methyl-4-amino-N-ethyl-β-methanesulfoneamidoethylanilinesesquisulfate monohydrade or 3-methyl-4-amino-N-β-hydroxyethylaniline sulfate in which alkyl sulfoneamide group or hydroxyalkyl group which is a water-soluble group is introduced into the N-alkyl group has been said to exhibit little difference in half-wave potential exhibiting the redox potential and both to be weak in developing activity, as can be seen from Photographic Science and Engineering Vol. 8, No. 3, May to June, 1964, pp. 125–137. Thus, it has been generally admitted that there is substantially no color developing agent which is high in developing activity for the inner latent image type silver chlorobromide emulsion and also excellent in processing stability, and 3-methyl-4-amino-N-ethyl-N-β-methanesulfoneamidoethylaniline sulfate has been generally used together with benzyl alcohol. However, in this case, as described above, the processing is susceptible to the influence by the change in the bromide ion concentration.

On the other hand, in the thickened reduced replenish processing in which the replenisher is reduced, there is another problem of increased entrainment of processing solution components. This is because the ratio of the tank solution renewed with the replenisher is lowered due to reduction in the amount replenished, and also because the term for use of the solution is prolonged. Entrainment of other processing solution is caused by the so-called back contamination in which the processing solution components immediately after development are brought into the color developing solution by splash or delivering leader or hangers for hanging belts or films in the adjacent processing solutions in the processing machine. Of these entrained components accumulated, thiosulfate ions which is the fixing agent dissolve silver halides and promote physical development, whereby the exposed portion having internally a latent image is developed to generate marked developing fogging. Thus, this problem occurs strongly particularly when direct bleach-fixing processing is applied after color development. Also, increased entrainment of a metal salt which is the bleaching agent, particularly, a ferric salt will promote decomposition of hydroxylamine which is a preservative to generate ammonia ions. This decomposition reaction is greatly acceletated at 30° C. or higher. Generation of the ammonia ions will accelerate physical development similarly as thiosulfate ions whereby involving the problem of generation of development fogging.

Accordingly, under the state of the art, even an amount to be replenished may be lowered for economical improvement and lowering in environmental polution, it would be strongly desirable to have a color developing solution which can be processed rapidly, and can maintain photographic performance constantly, and can be processed stably without decomposition of the effective components or change in photographic processing performance even when the processing solution may be used for a long term.

SUMMARY OF THE INVENTION

Figure 1:
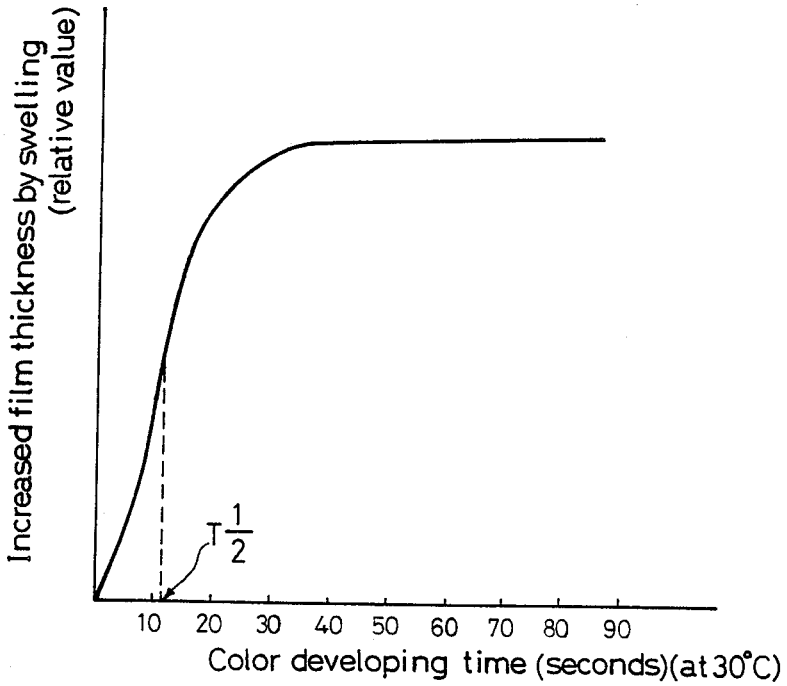
FIG. 1 shows a graph showing the film swelling speed $T\frac{1}{2}$ of a binder.

An object of the present invention is to provide a method for forming a direct positive color image, which can constantly maintain an adequate photographic performance over a long term without suffering from change in bromide ion concentration even when processed at a low amount replenished with the use of a color developing solution, and is also rapid and stable without generation of developing fog.

The present inventors studied variously in order to accomplish the above object of the present invention, and consequently successfully found a specific color developing agent which is substantially free from the influence by the bromide ion concentration during development of a specific silver halide, but came against an obstacle that developing fog was liable to be generated. Accordingly, further studies have been made about the method to solve this problem.

That is, a second object of the present invention is to provide a method for forming a direct positive color image which can inhibit generation of developing fog.

The present inventors also came against the following obstacle. That is, the density of cyan dye is lowered due to prolonged residence time of a color developing solution because the renewal percentage of the color developing solution in the processing tank with a replenishing solution is lowered on account of a small amount of processing. Further, it has been found that this problem is closely related to lowering in activity of the color developing solution accompanied with elongation of the residence time and also shortening of developing processing time accompanied with expedited developing processing.

That is, third object of the present invention is to provide a method for forming a direct positive color image which can prevent lowering in cyan dye density even when the processing amount may be lowered and the residence time of the color developing solution may be prolonged.

As a consequence, it has been found that the above objects can be accomplished by a method for forming a direct positive color image by subjecting an inner latent image type light-sensitive silver halide color photographic material for formation of a direct positive color image, having at least one light-sensitive emulsion layer containing inner latent image type silver halide grains which have not been previously fogged on the grain surfaces to color processing after image exposure, which comprises developing an inner latent image type light-sensitive silver halide color photographic material for formation of a direct positive color image in which the silver halide emulsion in said at least one layer of light-sensitive emulsion layer consists substantially of a silver chlorobromide emulsion with the use of a color developing solution containing N-hydroxyalkyl-substituted-p-phenylenediamine derivative at 30° C. or higher from 5 to 150 seconds, preferably at least 10 seconds and more preferably at least 15 seconds.

A preferable embodiment of the present invention is directed to the method in which the mean grain size of silver halide grains contained in at least blue-sensitive emulsion layer in the inner latent image type light-sensitive silver halide color photographic material is 1.7 $\mu$m or less.

Another preferable embodiment of the present invention is directed to the method in which the amount of silver coated on at least blue-sensitive emulsion layer in the inner latent image type light-sensitive silver halide color photographic material is 0.2 to 1 g/m$^2$ and the film swelling speed $T\frac{1}{2}$ of a binder is 30 seconds or shorter.

A further preferable embodiment of the present invention is directed to the method in which a red-sensitive emulsion layer in the inner latent image type light-sensitive silver halide color photographic material contains at least one of cyan couplers represented by the following formulae [I], [II] and [III]:

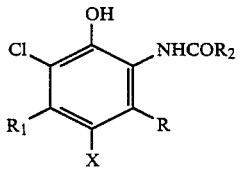

[I]

wherein one of R and $R_1$ repersents hydrogen atom and the other represents a straight or branched alkyl group having 2 to 12 carbon atoms; X represents hydrogen atom or an eliminable group through the coupling reaction with the oxidized product of N-hydroxyalkyl-substituted-p-phenylenediamine derivative contained in the color developing solution; and $R_2$ represents a balast group,

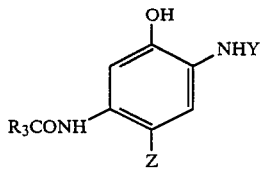

[II]

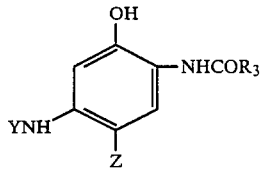

[III]

wherein Y represents

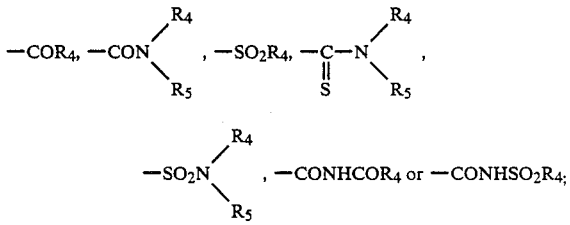

where $R_4$ represents an alkyl group, an alkenyl group, a cycloalkyl group, an aryl group or a hetero cyclic group; $R_5$ represents hydrogen atom, an alkyl group, an alkenyl group, a cycloalkyl group, an aryl group or heterocyclic group; $R_3$ represents a balast group; Z represents hydrogen atom or an eliminable group through the coupling reaction with the oxidized product of N-hydroxyalkyl-substituted-p-phenylenediamine derivative contained in the color developing solution.

DESCRIPTION OF THE PREFERRED EMBODIMENTS

The present inventors have found a surprising fact in development of an inner latent image type light-sensitive material using an inner latent image type emulsion of a specific silver halide, namely composed mainly of silver chlorobromide (particularly silver bromide content of 90 mole % or less), that the dye density will not substantially be lowered even if the bromide ion concentration may be increased, only when a N-hydroxyalkyl-substituted-p-phenylenediamine derivative is used as the color developing agent. The above specific feature of the color developing agent cannot be obtained from an inner latent image type light-sensitive material in which substantially silver iodobromide emulsion containing 0.5 mole % or more of silver iodide is used. Thus, this fact cannot be expected from the state of the art that this type of color developing agent has been used exclusively for development of a surface latent image type light-sensitive material using a silver iodobromide emulsion. This is also surprising enough, since such a phenomenon cannot be understood from the redox potential or half-wave potential of the color developing agent in general, and it will never occur unless probably optimum balance is maintained between the developing speed and the coupling speed and the fogged nucleus on the surface of unexposed silver halide grains formed by the fogging treatment is efficiently developed.

However, the present inventors came against the next obstacle. That is, when employing a N-hydroxyalkyl-substituted-p-phenylenediamine color developing agent, development can be effected rapidly and without receiving the influence by the change in the bromide ion concentration, particularly under high bromide ion concentration, whereby the amount of the developing solution supplemented in the case of continuous processing can be lowered to a great extent and processing stability is remarkably high. However, in spite of such great advantages, it has been found that there is involved the drawback that developing fog is liable to be generated.

The present inventors further tackled intensively the solution of this problem and consequently came to the conclusion that it could be solved particularly by performing the color developing processing within a short time. However, shortening of color developing time cannot easily be accomplished unless the developing process ability of the light-sensitive color photographic material cannot sufficiently improved. It has been found by the present invention that the necessary conditions for accomplishment of low flow replenishment and processing stability without accompaniment of generation of developing fog are 30° C. or higher and not longer than 150 seconds with the use of the color developing solution of the present invention.

In this case, there may sometimes ensue the problem that developing time is insufficient by use of the inner latent image type light-sensitive material of the prior art as it is to give not satisfactory photographic image. Accordingly, the present inventors have made further studies and consequently improved the developing speed by treating an inner latent image type light-sensitive material with a specific constitution as described below and were successful in accomplishing more effectively the above objects of the present invention by color developing rapidly the light-sensitive color photographic material at 30° C. or higher and within 150 seconds. That is, in order to perform low flow replenishment processing by use of the color developing agent of the present invention without influence by the increase in bromide ion concentration, there is employed an inner latent image light-sensitive material in which at least one layer, preferably all of the light-sensitive emulsion layers contain silver halide emulsions which are substantially silver chlorobromide emulsions and the mean grain size of the silver halide grains in at least the blue-sensitive emulsion layer (preferably all the light-sensitive emulsion layers) is 1.7 μm or less and/or an inner latent image type light-sensitive material in which the amount of silver coated is 1 g/m$^2$ or less and the film swelling speed $T_{\frac{1}{2}}$ of the binder is 30 seconds or shorter in at least the blue-sensitive emulsion layer (preferably in all the light-sensitive emulsion layers).

However, the present inventors have further made studies and consequently found that in the highly concentrated and lowly replenished processing in which the ratio of renewal of the tank solution with a replenisher is low and the developing solution is used for a long term, when the processing amount is lowered, the residence time of the color developing solution becomes extremely elongated to result in decomposition of effective ingredients, whereby particularly the density of cyan dye will be lowered as the result of lowering in activity.

It has been found at the same time that this problem will readily occur particularly when the development processing time is not longer than 150 seconds. Accordingly, the present inventors have further made studies to find out that this problem can be effectively solved by use of the cyan coupler of the present invention described later. This is the effect which can be obtained for the first time by use of the color developing agent of the present invention and it is an entirely unexpected effect which can be obtained for the first time by combination of the efficient development of the surface fogged nucleus of the unexposed silver halide grains formed by fogging treatment with the efficient coupling reaction between the quinonediimine formed by development and the coupler.

In the present specification "substantially silver chlorobromide emulsion" means that it can contain minute amount of silver iodide other than silver chlorobromide, for example, 0.3 mole % or less, more preferably 0.1 mole % or less of silver iodide. However, in the present invention, a silver chlorobromide emulsion containing no silver iodide is most preferred.

In the following, the present invention is described in more detail.

The inner latent image type light-sensitive material to be processed by the present invention has at least one light-sensitive emulsion layer containing inner latent image type silver halide grains which are not previously fogged on the grain surfaces.

By "not previously fogged on the grain surfaces" is meant that the density obtained when a test strip coated with the emulsion used in the present invention to 35 mgAg/cm$^2$ on a transparent film support is developed without exposure with the surface developing solution A shown below at 20° C. for 10 minutes does not exceed 0.6, preferably 0.4.

| Surface developing solution A | |
|---|---|
| Metol | 2.5 g |
| 1-ascorbic acid | 10 g |
| $NaBO_2\ 4H_2O$ | 35 g |
| KBr | 1 g |
| Water | added to one liter. |

Also, the silver halide emulsion according to the present invention gives sufficient density when the test strip as prepared above is developed after exposure with an inner developing solution B having the following recipe.

| Inner developing solution B | |
|---|---|
| Metol | 2 g |
| Sodium sulfite (anhydrous) | 90 g |
| Hydroquinone | 8 g |
| Sodium carbonate (monohydrate) | 52.5 g |
| KBr | 5 g |
| KI | 0.5 g |
| Water | added to one liter. |

To describe in more detail, when a part of the above test strip is exposed to a light intensity scale over a predetermined time up to about one second and developed with the inner developing solution B at 20° C. for 10 minutes, there is exhibited the maximum density which is at least 5-fold, preferably at least 10-fold of that obtained when another part of said test strip exposed under the same conditions is developed with the surface developing solution A at 20° C. for 10 minutes.

Of the light-sensitive emulsion layers in the inner latent image type light-sensitive material for formation of direct positive image processed according to the present invention, at least one layer may consist substantially of a silver chlorobromide emulsion, but preferably all the light-sensitive emulsion layer should consist of silver chlorobromide emulsions. Since satisfactory dye formation can be attained even by color developing within a short time as the mole % of silver bromide in said silver chlorobromide is smaller, the silver bromide content should preferably 10 to 90 mole %, optimally from 40 mole % to 70 mole % to give the most preferable results.

In the present specification, the mean grain size r means the grain size ri at which the product of $ni \times ri^3$ (in which ni is the frequency of the particles having a grain size of ri becomes the maximum (effective number of ciphers 3, with the numeral of the minimum cipher being rounded to the nearest whole number).

The grain size as herein mentioned refers to its diameter in the case of spherical silver halide grains or the diameter of the circle image of the same area of the projected image in the case of grains having a shape other than sphere. The grain size can be obtained by projecting the grains with enlargement by an electron-microscope to 10,000 to 50,000-fold and measuring the grain diameter or the area during projection on the print (the number of grains measured is made randomly 1,000 or more).

In the present specification, the words "mean grain size" is used in the sense as defined above.

The blue-sensitive emulsion layer of the present invention (preferably all the light-sensitive emulsion layers) should preferably contain grains with a mean grain size of 1.7 μm or less, more preferably 1.5 μm or less, further more preferably 1.4 μm or less, particularly 1.0 μm or less to give the maximum effect.

According to the preferable embodiments of this invention, the amount of silver coated in at least blue-sensitive emulsion layer (preferably all the light-sensitive emulsion layers) is 1 g/m$^2$ or less, and it is preferably smaller since satisfactory dye formation can be effected without delay of development relative to increase of the bromide and within a short time, particularly 0.8 g/m$^2$ or less, more preferably 0.6 g/m$^2$ or less to give the maximum effect.

Further, for the hydrophilic binder used for coating of the silver halide of the inner latent image type light-sensitive material, gelatin is generally used and also a high molecular weight polymer may be sometimes used. The film swelling speed $T\frac{1}{2}$ is preferably smaller than 30 seconds, and the film swelling speed $T\frac{1}{2}$ of the binder can be measured according to any known method in this field of the art, for example, by use of a swell-ometer as described in A. Green Photo. Sci, Eng., Vol. 19, No. 2, pp. 124–129, and $T\frac{1}{2}$ is defined as the time before reaching $\frac{1}{2}$ of the saturated film thickness, which is 90% of the maximum swelled film thickness reached when processed by color developing at 30° C. for 3 minutes and 30 seconds (see FIG. 1).

The binder in the photographic constituent layers to be used in the inner latent image type light-sensitive material of the present invention (referring to all the hydrophilic colloid layers on the support side provided by coating of light-sensitive emulsion layers, including also subbing layer, intermediate layer, overcoat layer, etc.) has its film swelling speed $T\frac{1}{2}$ of 30 seconds or less, and it is preferably as small as possilbe, but the lower limit may preferably be 2 seconds or longer from the standpoint of scratch damages, etc. Particularly preferably, it is 20 seconds or less, most preferably 15 seconds or less. If it exceeds 30 seconds, not only developing fog is liable to be generated, but also no satisfactory dye formation can be effected within 150 seconds. The film swelling speed $T\frac{1}{2}$ can be controlled by the amounts of the film hardening agent used. The amount of the film hardening agent used is not limited, but is preferably be within the range from 0.02 mg to 200 mg per g of gelatin.

Color developing processing is conducted at 30° C. or higher, for 150 seconds or shorter, preferably at 33° C. or higher, for 120 seconds or shorter, most preferably at 35° C. or higher, for 90 seconds or shorter. If processing is conducted at the temperature higher than 30° C. for the time longer than 150 seconds, developing fog will be worsened. Particularly, the processing time is more important rather than the temperature, and developing fog will be undesirably markedly increased at the upper most layer if the processing time exceeds 150 seconds. In the present invention, the processing time for color developing processing refers to the time after initiation of the fogging processing to initiation of the subsequent processing (e.g. bleach-fixing processing), and the predipping time before performing light fogging processing is not included in the processing time. The processing temperature is raised in order to complete development within a short time, but if it is too high, rather developing fog will be increased and therefore a temperature of 30° C. or higher and 50° C. or lower is preferable, particularly preferably 33° C. or higher and 48° C. or lower. Most preferably, the processing is carried out at 35° C. or higher and 43° C. or lower.

The effective developing agent in the present invention is a quaternary ammonium salt of a N-hydroxyalkyl-substituted-p-phenylenediamine compound, particularly one which can be represented by the following formula:

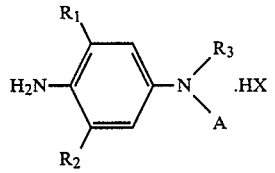

In the above formula, $R_1$ is a hydrogen atom, an alkyl group having 1 to 4 carbon atoms or an alkoxy group having 1 to 4 carbon atoms; $R_2$ is a hydrogen atom or an alkyl group having 1 to 4 carbon atoms; $R_3$ is an alkyl group having 1 to 4 carbon atoms which may have a hydroxyl group; A is an alkyl group which has at least one hydroxyl group and may also have a branching, more preferably:

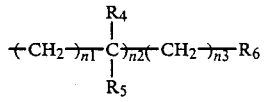

wherein $R_4$, $R_5$ and $R_6$ each represent a hydrogen atom, a hydroxyl group or an alkyl group having 1 to 3 carbon atoms which may have a hydroxyl group, at least one of $R_4$, $R_5$ and $R_6$ being a hydroxyl group or an alkyl group having a hydroxyl group; $n_1$, $n_2$ and $n_3$ are each 0, 1, 2 or 3; and HX represents hydrochloric acid, sulfuric acid, p-toluenesulfonic acid, nitric acid or phosphoric acid.

Such a p-phenylenediamine color developing agent is unstable in the form of its free amine, and is generally used in the form of a salt (most commonly as defined by the above formula). Typical examples may include 4-amino-3-methyl-N-ethyl-N-(β-hydroxyethyl)-aniline salt or 4-amino-N-ethyl-N-(β-hydroxyethyl)-aniline salt.

Preferably, in the present invention 4-amino-3-methyl-N-ethyl-N-(β-hydroxyethyl)-aniline sulfate monohydrate [this is commercially available under the name of CD-4 and used in most color photographic systems (for development of color negative films of, for example, C41 system of Eastman Kodak Co., CNK-4 system of Konishiroku Photo Industry Co.)] was recognized to be particularly effective.

Exemplary N-hydroxyalkyl-substituted-p-phenylenediamine derivatives preferably used in the present invention include those shown below, but these exemplary compounds are not limitative of the present invention.

[Exemplary compounds]

(1)

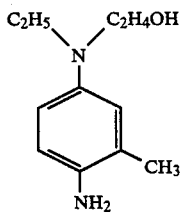

(2)

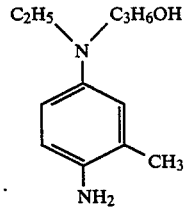

(3)

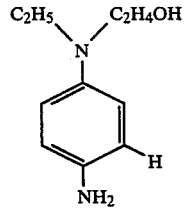

(4)

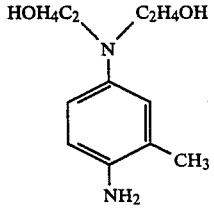

-continued

[Exemplary compounds]

(5)

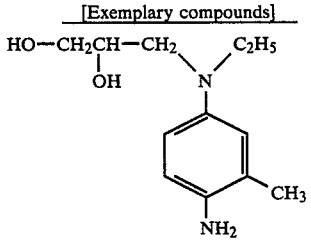

(6)

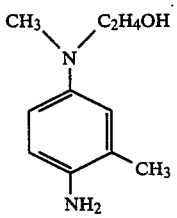

(7)

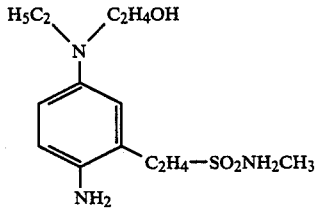

(8)

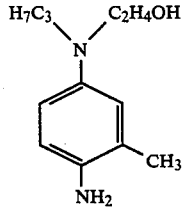

The above compounds (1) to (8) in the form of hydrochlorides, sulfates, p-toluenesulfonates are particularly preferred.

Of these exemplary compounds, those of No. (1), (2), (6), (7) and (8) can be preferably used, particularly preferably those of No. (1), (2) and (6). Further, No. (1) is above all preferred in the present invention.

Since the solubility of the color developing agent of the present invention in water is remarkably high, it is preferred to be used in an amount of 1 g to 100 g per liter of the processing solution, more preferably within the range from 3 g to 30 g.

These N-hydroxyalkyl-substituted-p-phenylenediamine derivatives of the present invention can be synthesized easily according to the method described in Journal of American Chemical Society Vol. 73, p. 3100 (1951).

The cyan coupler according to the present invention can be represented by the above formulae [I] to [III], and said formula [I] is described in more detail below.

In the present invention, the straight or branched alkyl group having 2 to 12 carbon atoms represented by $R_1$ and R in the above formula [I] may be, for example, ethyl, propyl, butyl groups.

In the formula [I], the ballast group represented by $R_2$ is an organic group having a size and a shape which can give sufficient bulkness to prevent substantially the coupler from being diffused from the layer in which the coupler is applied to other layers. Typical examples of the ballast group include alkyl groups or aryl groups having the total carbon atom number of 8 to 32, preferably the total carbon atom number of 13 to 28. These alkyl and aryl groups may have substituents, and examples of the substituent on aryl groups may include alkyl, aryl, alkoxy, allyloxy, carboxy, acyl, ester, hydroxy, cyano, nitro, carbamoyl, carbonamide, alkylthio, arylthio, sulfonyl, sulfoneamide, sulfamoyl groups and halogen atoms. Examples of the substituent on the alkyl group may include those as mentioned above on the aryl group except for the alkyl groups.

Preferable of said ballast group are those represented by the following formula:

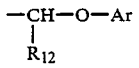

Wherein $R_{12}$ represents an alkyl group having 1 to 12 carbon atoms, Ar represents an aryl group such as phenyl, etc., and said aryl group may have substituents. Examples of the substituent may include alkyl groups, hydroxy group, halogen atoms, alkylsulfoneamide groups, etc., and the most preferable substituent is a branched alkyl group such as t-butyl, etc.

The group eliminable through the coupling reaction with the oxidized product of the color developing agent as defined by X in the above formula [I] determines the equivalent number of the coupler and also influences the reactivity of coupling, as well known to those skilled in the art. Typical examples include halogen atoms such as chlorine, fluorine, aryloxy groups, substitued or unsubstituted alkoxy groups, acyloxy groups, sulfoneamide groups, arylthio groups, heteroylthio groups, heteroyloxy groups, sulfonyloxy groups, carbamoyloxy groups, etc., more specifically, there may be included those disclosed in Japanese Unexamined Patent Publications Nos. 10135/1975, 120334/1975, 130414/1975, 48237/1979, 146828/1976, 14736/1979, 37425/1972, 123341/1975 and 95345/1983; Japanese Patent Publication No. 36894/1973; U.S. Pat. Nos. 3,476,563, 3,737,316 and 3,227,551; etc.

In the following, exemplary compounds of the cyan coupler represented by the formula [I] are enumerated, which are not limitative of the present invention. As said exemplary compounds, there may be included the compounds of the formula [I], in which $R_1$, X, $R_2$ and R are specified as shown below.

(Exemplary compounds)

| Coupler No. | $R_1$ | X | $R_2$ | R |
|---|---|---|---|---|
| C-1 | $-C_2H_5$ | $-H$ | 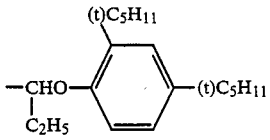 | $-H$ |
| C-2 | $-C_2H_5$ | $-Cl$ | 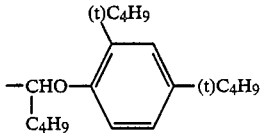 | $-H$ |
| C-3 | $-C_2H_5$ | $-H$ | 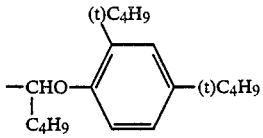 | $-H$ |
| C-4 | $-C_2H_5$ | $-Cl$ | 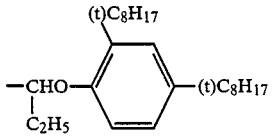 | $-H$ |
| C-5 | $-C_2H_5$ | $-Cl$ | 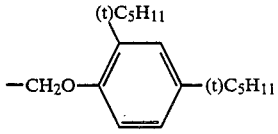 | $-H$ |
| C-6 | $-C_2H_5$ | 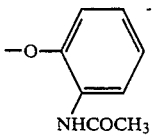 | 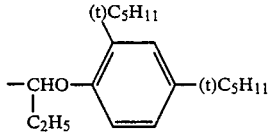 | $-H$ |

-continued (Exemplary compounds)

| Coupler No. | $R_1$ | X | $R_2$ | R |
|---|---|---|---|---|
| C-7 | $-CH(CH_3)_2$ | $-Cl$ | $-CH(C_2H_5)-CO-NH-C_6H_3-C_{15}H_{31}(n)$ | $-H$ |
| C-8 | $-C_2H_5$ | $-Cl$ | $-CH(C_2H_5)-CO-NH-C_6H_3-(t)C_5H_{11}-(t)C_5H_{11}$ | $-H$ |
| C-9 | $-C_2H_5$ | $-Cl$ | $-CH(C_4H_9)-CO-NH-C_6H_3-(t)C_5H_{11}-(t)C_5H_{11}$ | $-H$ |
| C-10 | $-C_4H_9$ | $-F$ | $-CH(C_2H_5)-CO-NH-C_6H_3-(t)C_5H_{11}-(t)C_5H_{11}$ | $-H$ |
| C-11 | $-C_2H_5$ | $-F$ | $-CH(C_{12}H_{25})-CO-NH-C_6H_3-OH-(t)C_4H_9$ | $-H$ |
| C-12 | $-C_2H_5$ | $-Cl$ | $-(CH_2)_3O-C_6H_3-(t)C_5H_{11}-(t)C_5H_{11}$ | $-H$ |
| C-13 | $-C_2H_5$ | $-F$ | $-CH-CO-NH-C_6H_3-(t)C_5H_{11}-(t)C_5H_{11}$ | $-H$ |
| C-14 | $-C_4H_9$ | $-Cl$ | $-CH(C_2H_5)-CO-NH-C_6H_3-(t)C_5H_{11}-(t)C_5H_{11}$ | $-H$ |
| C-15 | $-C_2H_5$ | $-Cl$ | $-CH(C_{12}H_{25})-CO-NH-C_6H_4-NHSO_2C_4H_9$ | $-H$ |
| C-16 | $-C_2H_5$ | $-Cl$ | $-CH(C_{12}H_{25})-CO-NH-C_6H_2-Cl_3$ | $-H$ |
| C-17 | $-CH(CH_3)_2$ | $-Cl$ | $-C_{18}H_{37}$ | $-H$ |

-continued
(Exemplary compounds)
| Coupler No. | $R_1$ | X | $R_2$ | R |
|---|---|---|---|---|
| C-18 | $-C_2H_5$ | $-F$ | 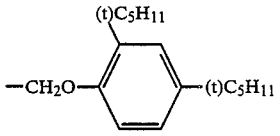 | $-H$ |
| C-19 | $-C_2H_5$ | 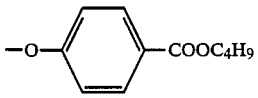 | 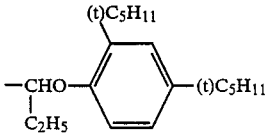 | $-H$ |
| C-20 | $-C_2H_5$ | $-Cl$ | 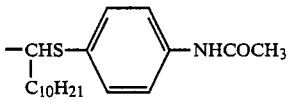 | $-H$ |
| C-21 | $-C_3H_7$ | $-Cl$ | 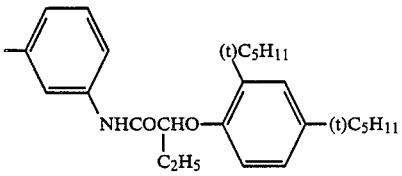 | $-H$ |
| C-22 | $-C_3H_7$ | $-Cl$ | 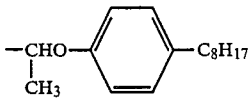 | $-H$ |
| C-23 | $-C_2H_4NHCOCH_3$ | $-Cl$ | 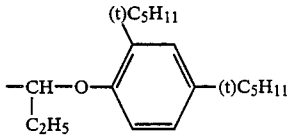 | $-H$ |
| C-24 | $-C_3H_6OCH_3$ | $-Cl$ | 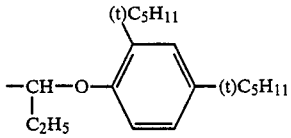 | $-H$ |
| C-25 | $-H$ | $-Cl$ | 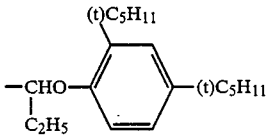 | $-C_2H_5$ |
| C-26 | $-H$ | $-Cl$ | 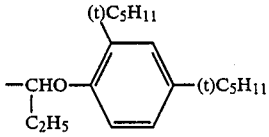 | $-C_3H_7$ |
| C-27 | $-H$ | $-Cl$ | 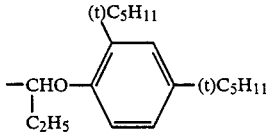 | $-C_5H_{11}$ |

-continued (Exemplary compounds)

| Coupler No. | $R_1$ | X | $R_2$ | R |
|---|---|---|---|---|
| C-28 | $-C_2H_5$ | —Cl | 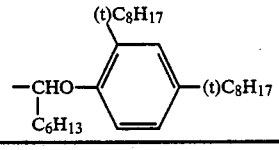 | —H |

In the following, the methods for synthesis of the exemplary compounds of the present invention are shown, and other exemplary compounds can be also synthesized according to the same methods.

Synthetic example of exemplary compound C-5

[(1)-a] Synthesis of 2-nitro-4,6-dichloro-5-ethylphenol

In 150 ml of glacial acetic acid were dissolved 33 g of 2-nitro-5-ethylphenol, 0.6 g of iodine and 1.5 g of ferric chloride. To the resultant solution was added dropwise 75 ml of sulfuryl chloride at 40° C. over 3 hours. The precipitate formed in the course of dropwise addition was dissolved by reflux after completion of the dropwise addition of sulfuryl chloride. It took about 2 hours to carry out the reflux. The reaction mixture was poured into water and the crystals formed were purified by recrystalization from methanol. Confirmation of (1)-a was conducted by NMR spectrum and elemental analysis.

[(1)] Synthesis of 2-nitro-4,6-dichloro-5-ethylphenol

To a solution of 21.2 g of the compound [(1)-a] in 300 ml of alcohol was added a catalytic amount of Raney nickel and hydrogen was passed into the mixture under normal pressure until hydrogen was no longer absorbed. After the reaction, Raney nickel was removed and alcohol was evaporated under reduced pressure. The residue of [(1)-b] was subjected to the subsequent acylation without purification.

[(1)-c] Synthesis of 2[2,4-di-tert-acylphenoxyacetamido]-4,6-dichloro-5-ethylphenol The crude amide obtained in [(1)-b] (18.5 g) was dissolved in a mixture comprising 500 ml of glacial acetic acid and 16.7 g of sodium acetate and an acetic acid solution containing 28.0 g of 2,4-di-tert-acylphenoxy acetic acid chloride dissolved in 50 ml of acetic acid was added dropwise thereto at room temperature.

After dropwise addition for 30 minutes, the mixture was further stirred for 30 minutes, and the reaction mixture was poured into ice-water. The precipitate formed was collected by filtration, dryed and recrystalized twice from acetonitrile to give the desired product. Confirmation of the desired product was conducted by elemental analysis and NMR spectrum.

| | $C_{21}H_{35}NO_3Cl$ | | | |
|---|---|---|---|---|
| | C | H | N | Cl |
| Calcd. (%) | 65.00 | 7.34 | 2.92 | 14.76 |
| Found (%) | 64.91 | 7.36 | 2.99 | 14.50 |

Next, the cyan coupler represented by the formula [II] or [III] to be used in the present invention is explained. In the above formula [II] and [III], Y is a group represented by $-COR_4$,

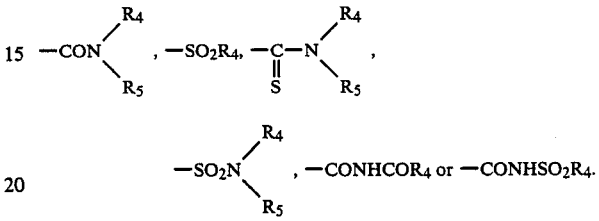

In these formulae, $R_4$ represents an alkyl group, preferably an alkyl group having 1 to 20 carbon atoms (e.g. methyl, ethyl, t-butyl, dodecyl, etc.), an alkenyl group, preferably an alkenyl group having 2 to 20 carbon atoms (e.g. allyl, heptadecenyl, etc.), a cycloalkyl group, preferably 5- to 7- membered ring (e.g. cyclohexyl, etc.) and aryl group (e.g. phenyl, tolyl, naphthyl, etc.), a heterocyclic group, preferably 5- to 6- membered heterocyclic group containing 1 to 4 nitrogen, oxygen or sulfur atoms (e.g. furyl, thienyl, benzothiazolyl, etc.). $R_5$ represents a hydrogen atom or a group represented by $R_4$. $R_4$ and $R_5$ may be bonded together to form a 5- to 6- membered heterocyclic ring. $R_2$ and $R_3$ may have any desired substituent introduced therein. Examples of the substituent include alkyl groups having 1 to 10 carbon atoms (e.g. methyl, i-propyl, i-butyl, t-butyl, t-octyl, etc.), aryl groups (e.g. phenyl, naphthyl groups, etc.), halogen atoms (e.g. fluorine, chlorine, bromine, etc.), cyano, nitro, sulfonamide groups (e.g. methane sulfonamide, butane sulfonamide, p-toluene sulfonamide, etc.), sulfamoyl groups (e.g. methylsulfamoyl, phenylsulfamoyl, etc.), sulfonyl groups (e.g. methanesulfonyl, p-toluenesulfonyl), fluorosulfonyl group, carbamoyl groups (e.g. dimethylcarbamoyl, phenylcarbamoyl, etc.), oxycarbonyl groups (e.g. ethoxycarbonyl, phenoxycarbonyl, etc.), acyl groups (e.g. acetyl, benzoyl, etc.), heterocyclic groups (e.g. pyridyl, pyrazolyl, etc.), alkoxy groups, aryloxy groups, acyloxy groups and others.

In the fomulae [II] and [III], $R_3$ represents a ballast group necessary for imparting diffusion resistance to the cyan coupler represented by the formula [II] and the formula [III] and the cyan dye formed from said cyan coupler. Preferably, it is an alkyl group having 4 to 30 carbon atoms, an aryl group or a heterocyclic group. For example, there may be included straight or branched alkyl groups (e.g. t-butyl, n-octyl, t-octyl, n-dodecyl, etc.), alkenyl groups, cycloalkyl groups, 5- or 6- membered heterocyclic rings.

In the formulae [II] and [III], Z represents a hydrogen atom or an eliminable group during the coupling reaction with the oxidized product of a N-hydroxyalkyl-substituted-p-phenylenediamine derivative developing agent. For example, there may be included halogen atoms (e.g. chlorine, bromine, fluorine, etc.), substituted or unsubstituted alkoxy groups, aryloxy groups, heterocyclicoxy groups, acyloxy groups, carbamoyloxy groups, sulfonyloxy groups, alkylthio groups, arylthio groups, heterocyclicthio groups, sulfonamide groups and others. Specific examples include those disclosed in U.S. Pat. No. 3,741,563; Japanese Unexamined Patent Publication No. 37425/1972; Japanese Patent Publication No. 36894/1973 and Japanese Unexamined Patent Publications Nos. 10135/1975, 117422/1975, 130441/1975, 108841/1976, 120343/1975, 18315/1977, 105226/1978, 14736/1979, 48237/1979, 32071/1980, 65957/1980, 1938/1981, 12643/1981, 27147/1981, 146050/1984, 166956/1984, 24547/1985, 35731/1985 and 37557/1985.

In the present invention, of the cyan couplers represented by the above formula [II] or [III], the cyan couplers represented by the following formulae [IV], [V] or [VI] are further preferred.

Formula [IV]

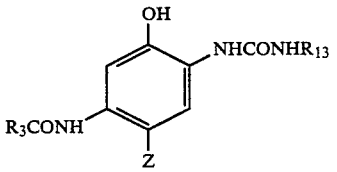

Formula [V]

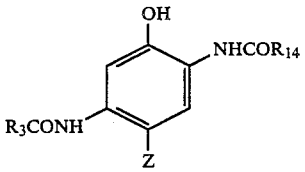

Formula [VI]

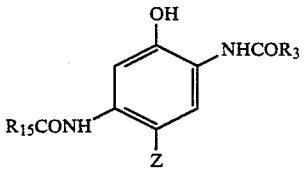

In the formula [IV], $R_{13}$ is a substituted or unsubstituted aryl group (particularly preferably a phenyl group). Examples of the substituent when said aryl group has a substituent may include at least one substituent selected from $SO_2R_{16}$, halogen atoms (fluorine, chlorine, bromine, etc.), $-CF_3$, $-NO_2$, $-CN$, $-COR_{16}$, $-COOR_{16}$, $-SO_2OR_{16}$,

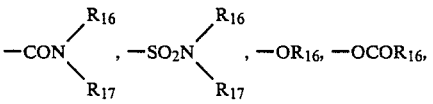

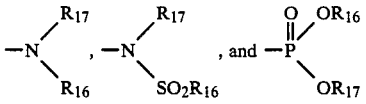

Here, $R_{16}$ represents an alkyl group, preferably an alkyl group having 1 to 20 carbon atoms (e.g. methyl, ethyl, tert-butyl, dodecyl, etc.), an alkenyl group, preferably an alkenyl group having 2 to 20 carbon atoms (e.g. allyl, heptadecenyl, etc.), a cycloalkyl group, preferably a 5- to 7- membered cyclic group (e.g. cyclohexyl, etc.), an aryl group (e.g. phenyl, tolyl, naphthyl, etc.), and $R_{17}$ is a hydrogen atom or a group represented by $R_{16}$.

Preferable compounds of the cyan coupler of the present invention represented by the formula [IV] are compounds in which $R_{13}$ is a substituted or unsubstituted phenyl group, and the substituent on the phenyl group is cyano, nitro, $-SO_2R_{18}$ ($R_{18}$ is an alkyl group), a halogen atom, or trifluoromethyl.

In the formulae [V] and [VI], $R_{14}$ and $R_{15}$ each represent an alkyl group, preferably an alkyl group having 1 to 20 carbon atoms (e.g. methyl, ethyl, tertbutyl, dodecyl, etc.), an alkenyl group, preferably an alkenyl group having 2 to 20 carbon atoms (e.g. allyl, oleyl, etc.), a cycloalkyl group, preferably a 5- to 7-membered cyclic group (e.g. cycloalkyl, etc.), an aryl group (e.g. phenyl, tolyl, naphthyl, etc.), a heterocyclic group (e.g. preferably 5- to 6- membered hetero ring containing 1 to 4 nitrogen, oxygen or sulfur atoms, such as furyl, thienyl, benzothiazolyl group, etc.).

In the above $R_{16}$, $R_{17}$ and $R_{14}$, $R_{15}$ in the formulae [V] and [VI], any desired substituent can be further introduced. Specific examples of the substituent include those which can be introduced into $R_4$ or $R_5$ in the formulae [II] and [III]. And halogen atoms (chlorine, fluroine, etc.) are particularly preferred as the substituent.

In the formulae [IV], [V] and [VI], Z and $R_3$ have the same meanings in the formulae [II] and [III], respectively. Preferable examples of the ballast group represented by $R_3$ groups are represented by the following formula [VII].

Formula [VII]

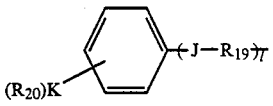

In the above formula, J represents an oxygen atom, a sulfur atom or a sulfonyl group, K represents an integer of 0 to 4, l represents 0 or 1, and when K is 2 or more, $R_{20}$ existing in number of two or more may be either the same or different. $R_{19}$ represents an alkylene group having 1 to 20 carbon atoms which is straight or branched, and substituted with an aryl group, etc., $R_{20}$ represents a monovalent group, preferably a hydrogen atom, a halogen atom (e.g. chloro, bromo), an alkyl group preferably a straight or branched alkyl group having 1 to 20 carbon atoms (e.g. methyl, t-butyl, t-pentyl, t-octyl, dodecyl, pentadecyl, benzyl, phenethyl, etc.), an aryl group (e.g. phenyl group), a heterocyclic group (e.g. nitrogen containing heterocyclic group), an alkoxy group, preferably a straight or branched alkoxy group having 1 to 20 carbon atoms (e.g. methoxy, ethoxy, t-butyloxy, octyloxy, decyloxy, dodecyloxy, etc.), an aryloxy group (e.g. a phenoxy group), a hydroxy group, an acyloxy group, preferably an alkylcarbonyloxy group, an arylcarbonyloxy group (e.g. acetoxy, benzoyloxy), carboxy, an alkyloxycarbonyl group, preferably a straight of branched alkylcarbonyl group having 1 to 20 carbon atoms, preferably a phenoxycarbonyl group, an alkylthio group, preferably an acyl group having 1 to 20 carbon atoms, preferably a straight or branched alkylcarbonyl group having 1 to 20 carbon atoms, an acylamino group, preferably a straight or branched alkylcarboamide group having 1 to 20 carbon atoms, a benzenecarboamide group, a sulfonamide group preferably a straight or branched alkyl sulfonamide group having 1 to 20 carbon atoms or a benzene sulfonamide group, a carbamoyl group, preferably straight or branched alkylaminocarbonyl group having 1 to 20 carbon atoms or a phenylaminocarbonyl group, a sulfamoyl group, preferably a straight or branched alkyl aminosulfonyl group having 1 to 20 carbon atoms or a phenylaminosulfonyl group, etc.

In the following, typical examples of the cyan coupler represented by the formula [II] or [III] are set forth, which are not limitative of the present invention.

[Exemplary compounds]

C-29

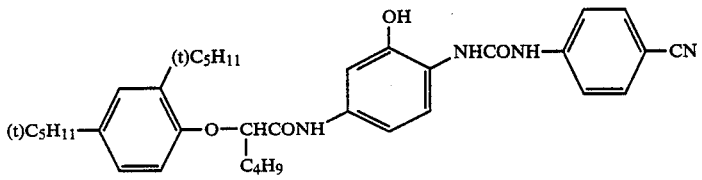

C-30

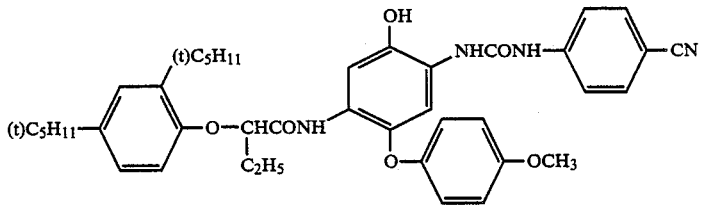

C-31

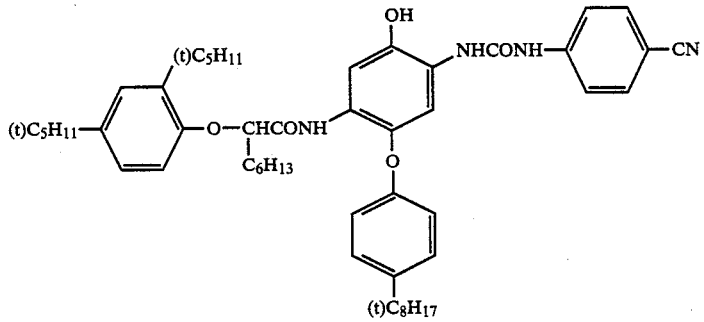

C-32

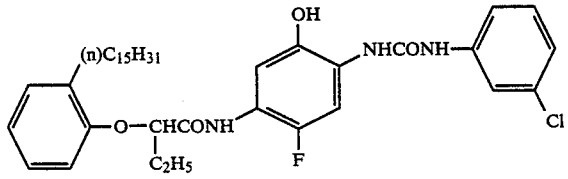

C-33

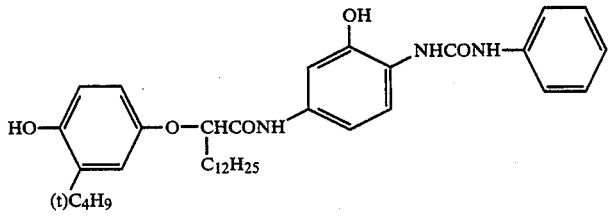

C-34

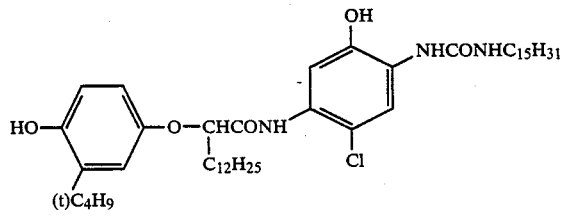

-continued
[Exemplary compounds]
C-35
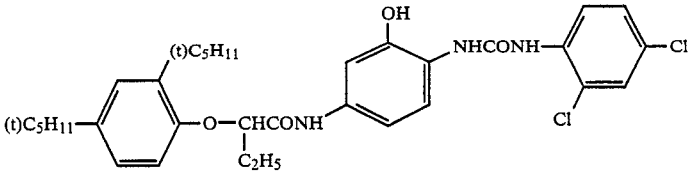
C-36
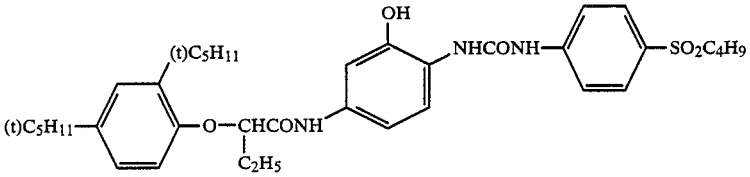
C-37
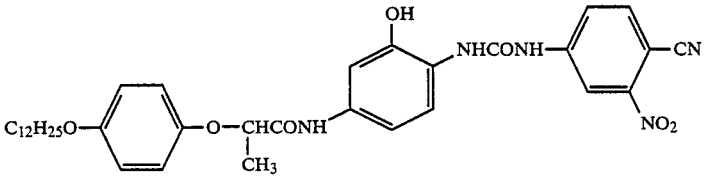
C-38
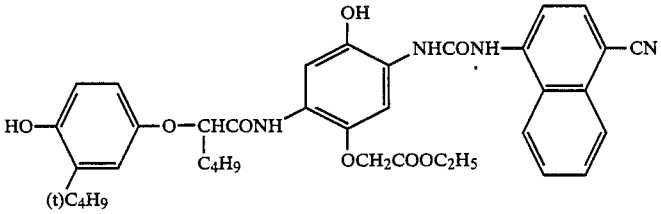
C-39
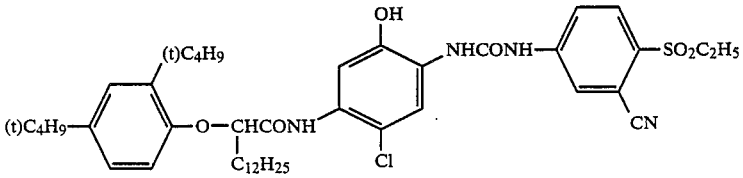
C-40
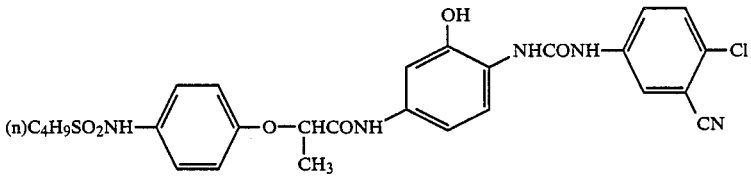
C-41
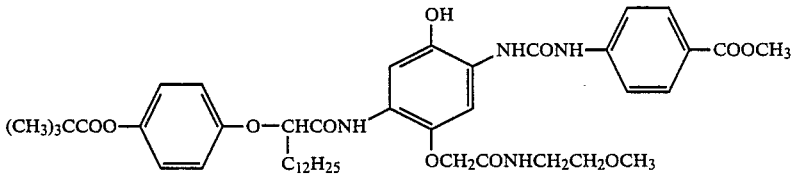
C-42
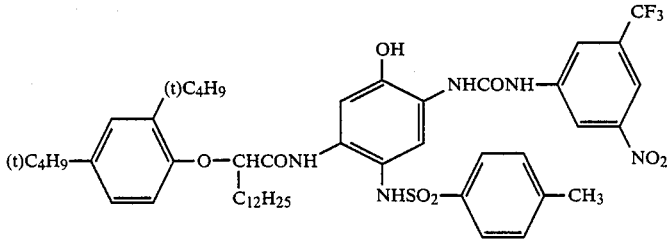

-continued

[Exemplary compounds]

C-43

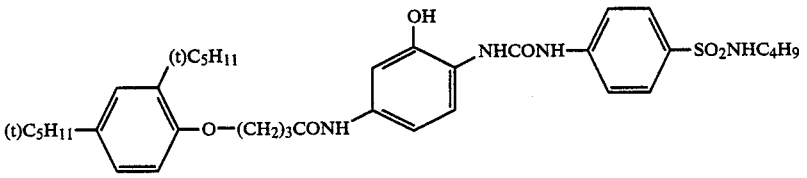

C-44

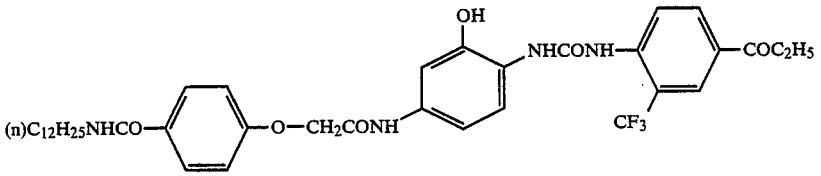

C-45

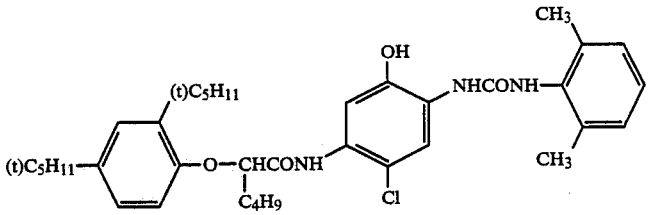

C-46

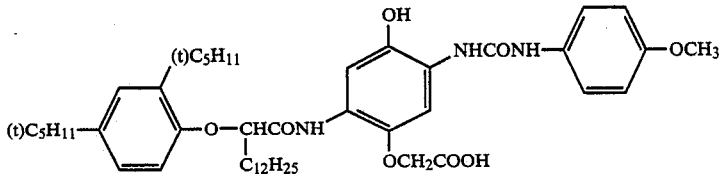

C-47

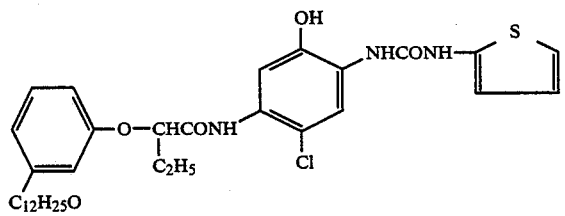

C-48

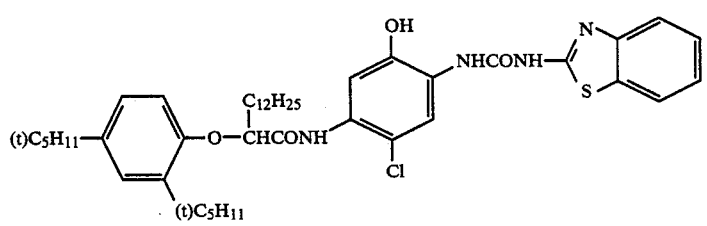

C-49

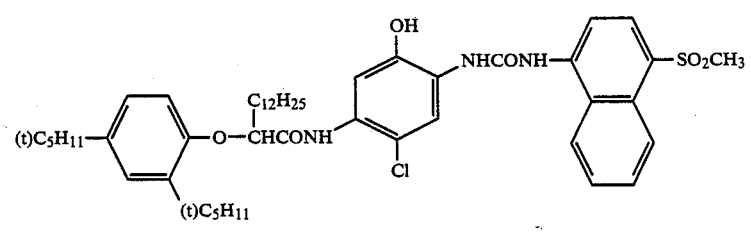

These cyan couplers of the present invention can be synthesized according to the known methods. In the case of the compounds represented by the formula [II], they can be synthesized according to the synthetic methods as described in U.S. Pat. Nos. 3,222,176, 3,446,622 and 3,996,253 and U.K. Pat. No. 1,011,940. In the case of the compounds represented by the formula [III], they can be synthesized according to the synthetic methods disclosed in, for example, U.S. Pat. Nos. 2,772,162, 3,758,308, 3,880,661 and 4,124,396; U.K. Pat. Nos. 975,773, 1,011,693 and 1,011,694; Japanese Unexamined Patent Publications Nos. 21139/1972, 112038/1975, 163537/1980, 29235/1981, 99341/1980, 116030/1981, 69329/1977, 55945/1981, 80045/1981 and 134644/1975 and also in U.K. Pat. No. 1,011,940; U.S. Pat. Nos. 3,446,622 and 3,996,253; Japanese Unexamined Patent Publications Nos. 65134/1981, 204543/1982, 204544/1982, 204545/1982, 33250/1983, 33248/1983, 33249/1985, 33251/1983, 33252/1983, 31334/1983, 37543/1984, 146050/1984, 166956/1984, 24547/1985, 35731/1985 and 37557/1985; etc.

The cyan couplers represented by the formula [I], [II], or [III] can be used with the cyan couplers outside the scope of the present invention within the range which does not impair the object of the present invention. Also, one or more of the cyan couplers of the formulae [I], [II] and [III] can be used in combination.

When the cyan coupler according to the present invention represented by the formulae [I] to [III] is incorporated in the silver halide emulsion layer it is used generally within the range of about 0.005 to 2 mols, preferably 0.01 to 1 mol per mol of silver halide.

The inner latent image type light-sensitive material of the present invention can be subjected to image exposure (photographing) according to a conventional method, followed by surface development to give easily a direct positive image. That is, the principal steps for preparation of direct positive image comprises subjecting the inner latent image type light-sensitive material of the present invention to the treatment of forming a fog nucleus by chemical action or photochemical action after image exposure and then, namely after application of the fogging treatment and/or while applying the fogging treatment carrying out the surface development. Here, the fogging treatment can be carried out by giving the whole surface exposure or by use of a compound capable of forming a fog nucleus, namely a fogging agent.

In the present inventionn, the fogging treatment should preferably be conducted by giving the whole surface exposure, because lowering in dye density accompanied with increase of bromide ion concentration is small. The whole surface exposure is generally given within the developer or outside of the developer after the light-sensitive material subjected to image exposure is dipped in the developer, and therefore it is susceptible to the effect by coloration or tarring of the developer caused by lowering in renewal of the developer due to low flow replenishment processing or prolonged residense time of the developer. However, the color developing agent of the present invention is little in such coloration or tarring and it is particularly suitable for the low flow replenishment processing in which fogging treatment is conducted by giving the whole surface exposure.

In the present invention, the whole surface exposure is carried out by dipping or wetting the inner latent image type light-sensitive material subjected to image exposure in a developer or another aqueous solution, followed by uniform exposure over the whole surface. As the light source to be employed here, any light within the sensitive wavelength region of the inner latent image type light-sensitive material may be available, and it is possible to irradiate a high luminance light such as a flush light for a short time or alternatively irradiate a weak light for a long time.

Such a luminance of light fog can be controlled by changing the luminosity of the light source, or by utilizing light reduction with various filters, the distance from the light source or the angle between the light-sensitive surface and the light source. Also, in order to shorten the exposure time for light fogging, it is possible to employ the method in which fogging is effected with weak light at the initial stage of exposure of light fogging and then with a stronger light.

The time for the whole surface exposure can be varied over a wide range depending on the inner latent image type light sensitive material, the developing conditions, the light source employed, etc., so that the best positive image can be finally obtained.

The whole surface exposure may be given to the inner latent image type light-sensitive material in a developer from the light source provided externally of the developing solution, or alternatively to the inner latent image type light sensitive material which is once taken out of the developing solution. Alternatively, the whole exposure can be given in the developing solution from a light source provided in the developing solution. These methods can be also used in combination.

In the present invention, the fogging treatment can be conducted by effecting developing processing in the presence of a fogging agent. In this case, as the fogging agent to be used, various kinds of compounds can be used, and the fogging agent may be present during the developing processing. For example, it can be contained in a constituent layer of the light-sensitive photographic material other than the support (among them, silver halide emulsion layer is particularly preferred), or in a developing solution or in processing solutions prior to developing processing. Its amounts can be varied over a wide range depending on the purpose, and it is preferable to use 1 to 1,500 mg, more preferably 10 to 1,000 mg of the fogging agent per mol of the silver halide when it is added in the silver halide emulsion layer. On the other hand, when added in processing solutions such as developing solution, preferable amount added may be 0.01 to 5 g/liter, particularly preferably 0.05 to 1 g/liter.

Examples of the fogging agent to be used in the present invention include hydrazines disclosed in U.S. Pat. Nos. 2,563,785 and 2,588,982, or hydrazide or hydrazone compounds disclosed in U.S. Pat. Nos. 3,227,552; heterocyclic quaternary nitrogen salt compounds disclosed in U.S. Pat. Nos. 3,615,615, 3,718,479, 3,719,494, 3,734,738 and 3,759,901; and further compounds having adsorptive groups onto the silver halide surface such as acylhydrazinophenylthio ureas disclosed in U.S. Pat. No. 4,030,925. Also, these fogging agents may be used in combination. For example, Research Disclosure No. 15162 describes about using a non-adsorptive type fogging agent and an adsorptive type fogging agent in combination, and this combined use technique is also effective in the present invention.

As the fogging agent to be used in the present invention, either nonadsorptive type or adsorptive type can be used and it is also possible to use both of them in combination.

Typical examples of useful fogging agents include hydrazine compounds such as hydrazine hydrochloride, phenylhydrazine hydrochloride, 4-methylphenylhydrazine hydrochloride, 1-formyl-2-(4-methylphenyl)hydrazine, 1-acetyl-2-phenyl-hydrazine, 1-acetyl-2-(4-acetamidophenyl)hydrazine, 1-methylsulfonyl-2-phenylhydrazine, 1-benzoyl-2-phenyl-hydrazine, 1-methylsulfonyl-2-(3-phenylsulfonamidophenyl)hydrazine, formaldehyde phenylhydrazine; N-substituted quaternally cycloammonium salts such as 3-(2-formylethyl)-2-methylbenzothiazoliumbromide, 3-(2-formylethyl)-2-propylbenzothiazoliumbromide, 3-(2-acetylethyl)-2-benzylbenzoselenazoliumbromide, 3-(2-acetylethyl)-2-benzyl-5-phenyl-benzooxazoliumbromide, 2-methyl-3-[3-(phenylhydrazino)propyl]benzothiazoliumbromide, 2-methyl-3-[3-(p-tolylhydrazino)-propyl]benzothiazoliumbromide, 2-methyl-3-[3-(p-sulfophenylhydrazino)propyl]benzothiazoliumbromide, 2-methyl-3-[3-(p-sulfophenylhydrazino)pentyl]benzothiazolium iodide, 1,2-dihydro-3-methyl-4-phenylpyrido[2,1-b]benzothiazoliumbromide, 1,2-dihydro-3-methyl-4-phenylpyrido-[2,1-b]-5-phenylbenzooxazoliumbromide, 4,4'-ethylenebis-(1,2-dihydro-3-methylpyrido[2,1-b]benzothiazoliumbromide, 1,2-dihydro-3-methyl-4-phenylpyrido[2,1-b]benzoselenazoliumbromide; 5-[1-ethylnaphtho(1,2-b)thiazolin-2-ylideneethylydene]-1-(2-phenylcarbazoyl)methyl-3-(4-sulfamoylphenyl)-2-thiohydantion, 5-(3-ethyl-2-benzothiazolinylidene)-3-[4-(2-formylhydrazino)phenyl]rhodanine, 1-[4-(2-formylhydrazino)phenyl]3-phenylthiourea, 1,3-bis[4-(2-formylhydrazino)phenyl]thiourea, and so on.

The color developer of the present invention should preferably have a bromide ion concentration of $5\times10^{-3}$ mol or higher, and the bromide ion concentration in the present invention is preferably as high as possible because the amount replenished can be lowered. Although, in the developing system of the prior art, a bromide which inhibits the developing reaction is preferred to be as low as possible, according to the combination of the inner latent image type light-sensitive material and the developer of the present invention the bromide is preferably as high as possible, as entirely contrary to the practice of the prior art, whereby the object of the present invention can be more readily accomplished. In other words, according to the present invention, it has been rendered possible to lower the amount to be replenishment because development is little affected by the bromide.

The bromide ion concentration should preferably be $1\times10^{-2}$ mol or higher per liter of color developer, particularly preferably $1.5\times10^{-2}$ mol or higher per liter of color developer. If the bromide ion concentration is too high, development is inhibited and therefore a concentration of $6\times10^{-2}$ mol or higher per liter of color developer at which the influence by the bromide ion concentration begins to be exhibited is not preferable. The concentration of chloride has no effect on development.

For the processing system of the inner latent image type light-sensitive material of the present invention, it is possible to use a color developing bath containing the color developing agent according to the present invention as described above. It is also possible to use other various kinds of methods typically of bath processing, such as the spray system in which the processing solution is atomized or the Wepp system by contact with a carrier impregnated with a processing solution, or the developing method by use of a viscous processing solution or other various processing systems.

In addition to those as mentioned above, the processing method for the inner latent image type light-sensitive material of the present invention is not particularly limited, but all porcessing methods are applicable. For example, representative methods include the method in which after color developing, bleach-fixing processing is performed, followed further by water washing and/or stabilizing processing, if desired; the method in which after color development, bleaching and fixing are perfomed separately, followed further by water washing and/or stabilizing processing, if desired; or the method in which pre-film-hardening, neutralization, color developing, stopping fixing, water washing, bleaching, fixing, water washing, post-film hardening, water washing are conducted in the order stated; the method in which color development, water washing, color development to be replenished, stopping, bleaching, fixing, water washing and stabilizing are conducted in the order are stated; the method in which the developed silver formed by color development is subjected to halogenation bleach, followed again by color development to increase the amount of dye formed; etc. Any of these methods can be used for processing.

The color developing solution to be used in the present invention may further contain various components generally added, including alkali agents such as sodium hydroxide, sodium carbonate, etc., alkali metal sulfites, alkali metal hydrogen sulfites, alkali metal thiocyanates, alkali metal halides, benzyl alcohol, water softeners, thickeners and development accellerators, as desired.

Other additives than those mentioned above to be added into the color developing solution may include, for example, compounds for rapid processing solutions such as bromides (e.g. potassium bromide, sodium bromide), alkali iodides, nitrobenzoimidazole, mercaptobenzoimidazole, 5-methyl-benzotriazole, 1-phenyl-5-mercaptotetrazole, etc., the tetrazaindene derivatives as descirbed in Japanese Patent Publication No. 43735/1983, and otherwise stain preventives, sludge preventives, preservatives, overlaying effect promoters, chelating agents, etc.

The pH value of the color developing solution may suitably be generally 7 or higher, preferably in the range from 9 to 13.

As the bleaching agent to be used in the bleaching solution or the bleach-fixing solution in the bleacing step, organic acids such as aminopolycarboxylic acid or oxalic acid, citric acid, etc., having metal ions such as ion, cobalt, copper, etc., coordinated are generally known, and, typical examples of the above amino polycarboxylic acid include the following;

Ethylenediaminetetraacetic acid
Diethylenetriaminepentaacetic acid
Propylenediaminetetraacetic acid
Nitrilotriacetic acid
Iminodiacetic acid
Glycoletherdiaminetetraacetic acid
Ethylenediaminetetrapropionic acid
Disodium ethylenediaminetetraacetate
Pentasodium diethylenetriaminepentaacetate
Sodium nitrilotriacetate.

The bleaching solution may also contain various additives together with the above bleacing agent. Also, when a bleach-fixing solution is used in the bleaching step, a solution with a composition containing a silver halide fixing agent in addition to the above bleaching agent is applied. Further, the bleach-fixing solution may contain a halide compound such as potassium bromide. And, similarly as in the case of the above bleaching solution, other various additives may also be added to be incorporated, such as pH buffers, fluorescent brighteners, defoaming agent, surfactants, preservatives, chelating agents, stabilizers, organic solvents, etc.

As the silver halide fixing agent, there may be included compounds capable of forming water-soluble silver salts through the reaction with silver halide as conventionally used in fixing treatment, such as sodium thiosulfate, ammonium thiosulfate, potassium thiocyanate, sodium thiocyanate or thiourea, thioether, etc.

In processings other than color developing of the inner latent image type light-sensitive material of the present invention, such as bleach-fixing (or bleaching, fixing), further various processing steps such as water washing, stabilizing, etc., optionally conducted, the processing temperature may preferably be 30° C. or higher from the standpoint of rapid processing.

The inner latent image type light-sensitive material of the present invention may be subjected to the stabilizing processing substituting for water washing as disclosed in Japanese Unexamined Patent Publications Nos. 14834/1983, 105145/1983, 134634/1983, 18631/1983, 126553/1984 and 233651/1985.

The inner latent image type silver halide emulsion to be used in the present invention include those prepared according to various methods. For example, there may be included the conversion type silver halide emulsion disclosed in U.S. Pat. No. 2,592,250; silver halide emulsions containing silver halide grains internally chemically sensitized disclosed in U.S. Pat. Nos. 3,206,316, 3,317,322 and 3,367,778; silver halide emulsions having silver halide grains including polyvalent metal ions disclosed in U.S. Pat. Nos. 3,271,157, 3,447,927 and 3,531,291; silver halide emulsions weakly chemically sensitized at the grain surfaces of silver halide grains containing doping agents disclosed in U.S. Pat. No. 3,761,276; the so called core-shell type silver halide emulsions comprising grains having a laminated structure disclosed in Japanese Unexamined Patent Publication Nos. 8524/1975, 38525/1975 and 2408/1978; or silver halide emulsions disclosed in Japanese Unexamined Patent Publication Nos. 156614/1977, 127549/1980 and 79940/1982.

The inner latent image type light-sensitive material of the present invention, in a multi-layer light-sensitive color photographic material having three layers or more containing a blue-sensitive emulsion layer, a green-sensitive emulsion layer and a red-sensitive emulsion layer, respectively, exhibits the greatest effect when half of the time before its film swelling time becomes maximum, namely the film swelling speed $T\frac{1}{2}$ is 30 seconds or shorter. Its total film thickness on drying may be 14 μm or less, preferably 13 μm or less, particularly preferably 12 μm or less, and $T\frac{1}{2}$ should preferably be 30 seconds or shorter in any case.

Further, in the inner latent image type silver halide emulsion to be used in the present invention 1 mg to 10 g of a compound having an azaindene ring and a nitrogen-containing heterocyclic compound having a mercapto group, etc., per mol of silver halide can be contained to give more stable results having lower minimum density.

As the compound having an azaindene ring, 4-hydroxy-6-methyl-1,3,3a, 7-tetrazaindene is preferred. As a nitrogen-containing heterocyclic compound having a mercapto group, 1-phenyl-5-mercaptotetrazole is preferred.

Otherwise, in the silver halide emulsion, as antifoggant or stabilizer, for example, mercury compounds, triazole type compounds, azaindene type compounds, benzothiazolium type compounds, zinc compounds, etc., can be contained.

In the inner latent image type silver halide emulsion to be applied in the present invention, various kinds of photographic additives can be added as desired. For example, the optical sensitizer available in the present invention may include cyanines, melocyanines, tri-nucleus or tetra-nucleus melocyanines, tri-nucleus or tetra-nucleus cyanines, styryls, holopolar cyanines, hemicyanines, oxonols and hemioxonols. These optical sensitizers should preferably contain as the nitrogen-containing heterocyclic nucleus a basic group such as thiazoline, thiazole, etc., or a nucleus such as rhodanine, thiohydantoin, oxazolidindione, barbituric acid, thiobarbituric acid, pyrazolone, etc., as a part of its structure. Such a nucleus can be substituted with alkyl, hydroxyalkyl, sulfoalkyl, carboxyalkyl, halogen, phenyl, cyano and alkoxy, or it may be fused with a homocyclic ring or a heterocyclic ring as desired.

The inner latent image type silver halide emulsion to be used in the present invention can be subjected to supersensitization. The method of supersensitization is described in, for example, "Reveiw of Supersensitization", Photographic Science and Engineering (PSE) Vol. 18, p. 4418 (1974).

In the inner latent image type silver halide emulsion layer according to the present invention, respective couplers, namely compounds capable of forming dyes through the reaction with the oxidized product of a color developing agent can be contained.

The above couplers useful in the present invention include various yellow couplers, magenta couplers and cyan couplers without any special limitation. These couplers may be either the so-called divalent type or tetravalent type couplers and in combination with these couplers, diffusible dye release type couplers, etc., can also be used. The above yellow couplers may include open-chain ketomethylene compounds, and further the so-called divalent type couplers, activation site-o-aryl-substituted couplers, activation site-o-acyl-substituted couplers, activation site hydantoin compound-substituted couplers, activation site urazole compound-substituted couplers, activation site succinimide compound-substituted couplers, activation site fluorine-substituted couplers, activation site chlorine or bromine-substituted couplers, activation site-o-sulfonyl-substituted couplers as effective yellow couplers. Typical examples of useful yellow couplers are disclosed in U.S. Pat. Nos. 2,875,057, 3,265,506, 3,408,194, 3,551,155, 3,582,322, 3,725,072 and 3,891,445; West Germany Patent No. 15 47 868, West Germany Laid-open Patent Publication Nos. (OLS) 22 19 917, 22 61 361, and 24 14 006; U.K. Patent No. 1,425,020; Japanese Patent Publication No. 10783/1976, Japanese Unexamined Patent Publication Nos. 26133/1972, 73147/1973, 102636/1976, 6341/1975, 123342/1975, 130442/1975, 21827/1976, 87650/1975, 82424/1977, 115219/1977 and 95346/1983.

As the magenta coupler to be used in the present ivention, there may be included pyrazolone type, pyrazolotriazole type, pyrazolinobenzimidazol type, indazolone type compounds. These magenta couplers are not only tetravalent type couplers but also divalent type couplers similarly as the yellow couplers. Typical examples of the magenta coupler are disclosed in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445; West Germany Patent No. 18 10 464; West Germany Laid-open Patent Publication Nos. (OLS) 24 08 665, 24 17 945, 24 18 959 and 24 24 467; Japanese Patent Publication No. 6031/1965; Japanese Unexamined Patent Publication Nos. 20826/1976, 58922/1977, 129538/1974, 74027/1974, 159336/1975, 42121/1977, 74028/1974, 60233/1975, 26541/1976 and 55122/1978.

As mentioned above, in the preferred embodiment of the present invention it is preferable to use at least one cyan coupler selected from the above formulae [I], [II] and [III], or alternatively phenol type, naphthol type couplers other than these cyan couplers may also be used in combination with these cyan couplers. And, these cyan couplers are not limited to only tetraequivalent type couplers but they can be diequivalent type couplers similarly as yellow couplers. Typical examples of cyan couplers are disclosed in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 3,772,002, 3,933,494 and 4,004,929; West Germany Laid-open Patent Publication Nos. (OLS) 24 14 830 and 24 54 329; Japanese Unexamined Patent Publication Nos. 59838/1973, 26034/1976, 5055/1973, 146827/1976, 69624/1977, 90932/1977 and 95346/1983; Japanese Patent Publication No. 11572/1974.

Also, the cyan couplers other than those of the above formulae [I], [II] and [III] can be used in combination with at least one cyan coupler selected from the above formulae [I], [II] and [III].

In the silver halide emulsion layer and other photographic constituent layers of the present invention, there may be also employed couplers in combination such as non-diffusive DIR compounds, colored magenta or cyan couplers, polymer couplers, diffusive DIR compounds, etc. As for non-diffusive DIR compounds, colored magenta or cyan couplers, reference may be made to the description in Japanese Unexamined Patent Publication No. 72235/1986 filed by the present Applicant, and as for polymer couplers, reference may be made to Japanese Unexamined Patent Publication No. 50143/1986 filed by the present Applicant.

The above couplers available in the present invention can be added in the photographic constituent layers of the present invention according to the methods as practiced in the prior art. The amount of the above coupler is not limited, but preferably be $1\times10^{-3}$ to 5 moles per mole of silver, more preferably $1\times10^{-2}$ to $5\times10^{-1}$ mole. Here, in the red-sensitive emulsion layer, the cyan coupler represented by the formula [I], [II] or [III] is preferably contained in an amount of 5 mole % or more, more preferably 10 mole % or more, most preferably 20 mole % or more based on the total cyan coupler, to give better results.

For incorporating the cyan coupler of the present invention and other couplers in the silver halide emulsion according to the present invention, when said couplers are alkali-soluble, they may be added as alkaline solutions; when they are oil-soluble, they can preferably be dissolved in a high boiling solvent, optionally together with a low boiling solvent, according to the methods as disclosed in U.S. Pat. Nos. 2,322,027, 2,801,170, 2,801,171, 2,272,191 and 2,304,940 to be dispersed in fine particles before addition into the silver halide emulsion. If desired, a hydroguinone derivative, a UV-ray absorber, a color fading preventive, etc. may also be used in combination. Also, two or more kinds of couplers may be used as a mixture. Further, to describe in detail about the method for addition of the cyan couplers according to the present invention, one or two or more kinds of the cyan couplers according to the present invention, optionally together with other couplers, a hydroquinone derivative, a color fading preventive, a UV-ray absorber, etc., are dissolved in a high boiling solvent such as organic acid amides, carbamates, esters, ketones, urea derivatives, ethers, hydrocarbons, specifically di-n-butyl phthalate, tricresyl phosphate, triphenyl phosphate, di-isooctylazelate, di-n-butylsebacate, tri-n-hexylphophate, N,N-diethylcaprylamidobutyl, N,N-diethylluaurylamide, n-pentadecylphenylether, dioctylphthalate, n-nonylphenol, 3-pentadecylphenyl ethyl ether, 2,5-di-sec-amylphenyl butyl ether, monophenyl-di-o-chlorophenyl phosphate or fluoroparaffins, and/or a low boiling solvent such as methyl acetate, ethyl acetate, propyl acetate, butyl acetate, butyl propionate, cyclohexanol, diethyleneglycol monoacetate, nitromethane, carbon tetrachloride, chloroform, cyclohexene, tetrahydrofuran, methyl alcohol, acetonitrile, dimethylformamide, dioxane, methyl ethyl ketone, etc., the resultant solution is mixed with an aqueous solution containing an anionic surfactant such as alkylbenzenesulfonic acid and alkylnaphthalenesulfonic acid and/or a nonionic surfactant such as sorbitane sesquioleic acid ester and sorbitane monolauryl acid ester and/or a hydrophilic binder such as gelatin, etc., emulsified by means of a high speed rotary mixer, a colloid mill or a sonication dispersing device, etc. and added into the silver halide emulsion.

Otherwise, the above coupler may also be dispersed by use of the latex dispersing method. The latex dispersing method and its effect are described in Japanese Unexamined Patent Publication Nos. 74538/1974, 59943/1976, 32552/1979 and Research Disclosure, August, 1976, No. 14850, pp. 77 to 79.

Suitable latices are homopolymers, copolymers or terpolymers of monomers such as styrene, acrylate, n-butyl acrylate, 2-acetoacetoxyethyl methacrylate, 2-(methacryloyloxy)ethyltrimethylammoniummethosulfate, sodium 3-(methacryloyloxy)propane-1-sulfonate, N-isopropylacrylamide, N-[2-(2-methyl-4-oxopentyl)]acrylamide, 2-acrylamide-2-methylpropanesulfonic acid, etc.

In the inner latent image type light-sensitive material of the present invention, various kinds of other additives for photography can be contained. For example, there can be employed, UV-ray absorbers, color staining preventives, fluorescent brighteners, color image fading preventives, antistatic agents, film hardeners, surfactants, plastifiers, wetting agents, etc., as disclosed in Research Disclosure No. 17643.

In the silver halide emulsion layer according to the present invention, as a protective colloid or a binder, suitable gelatin derivatives depending on the purpose other than gelatin can be used. Examples of the suiltable gelatin derivative include acylated gelatin, guanidilated gelatin, carbamylated gelatin, cyanoethanolated gelatin, esterified gelatin and the like.

Also, in the present invention, other hydrophilic binders can be contained depending on the purpose. Such binders may include colloidal albumin, agar, gum arabic, dextran, alginic acid, cellulose derivatives such as cellulose acetate hydrorized to acetyl content of 19 to 20%, polyacrylamide, imidated polyacrylamide, casein, vinyl alcohol polymer containing urethane carboxylic acid group or cyanoacetyl group such as vinyl alcohol-vinyl aminoacetate copolymer, polyvinyl alcohol, polyvinylpyrrolidone, hydrolyzed polyvinyl acetate, polymers obtained by polymerization of a protein or a saturated acylated protein with a monomer having a vinyl group, polyvinylpyridine, polyvinylamine, polyaminoethyl methacrylate, polyethyleneamine, etc. They can be added depening on the purpose in the light-sensitive photographic material constituent layers such as emulsion layer or intermediate layer, protective layer, filter layer, backing layer, etc. Further, the above hydrophilic binder can incorporate suitable plasticizers, lubricants, etc., depending on the purpose.

Also, the constituent layers of the inner latent image light-sensitive material according to the present invention can be hardened with any suitable film hardening agent. Examples of these film hardening agents include chromium salts, zirconium salts, aldehyde type compounds halotriazine type compounds or polyepoxy compounds such as formaldehyde or mucohalogenic acid, ethyleneimine type, vinylsulfone type, acryloyl type film hardening agents, etc.

The film hardening agent to be preferably used in the present invention include aldehyde type, aziridine type (e.g. those disclosed in PB report 19,921, U.S. Pat. Nos. 2,950,197, 2,964,404, 2,983,611 and 3,271,175; Japanese Patent Publication No. 40898/1971; Japanese Unexamined Patent Publication No. 91315/1975), isooxazole type, epoxy type (e.g. those disclosed in U.S. Pat. No. 3,047,394; West Germany Patent No. 10 85 663; U.K. Patent No. 1,033,518; Japanese Patent Publication No. 35495/1973), vinylsulfone type (e.g. those disclosed in PB report 19,920; West Germany Patent Nos. 11 00 942, 23 37 412, 25 45 722, 26 35 518, 27 42 308 and 27 49 260; U.K. Patent No. 1,251,091; U.S. Pat. Nos. 3,539,644 and 3,490,911; etc.), acryloyl type (e.g. those disclosed in U.S. Pat. No. 3,640,720), carbodiimide type (e.g. those disclosed in U.S. Pat. Nos. 2,938,892, 4,043,818 and 4,061,499; Japanese Patent Publication No. 38715/1971; etc.), triazine type (e.g. West Germany Patent Nos. 24 10 973 and 25 53 915; U.S. Pat. No. 3,325,287; Japanese Unexamined Patent Publication No. 12722/1977; etc.), polymer type (e.g. those disclosed in U.K. Patent No. 822,061; U.S. Pat. Nos. 3,623,878, 3,396,029 and 3,226,234; Japanese Patent Publication Nos. 18578/1972, 18579/1972, 48896/1972), otherwise maleimide type, acetylene type, methanesulfonic acid ester type (N-methylol type). These film hardening agents may be used either singly or in combination. Useful combination techniques include, for example, the combinations as disclosed in West Germany Patent Nos. 24 47 587, 25 05 746 and 25 14 245; U.S. Pat. Nos. 4,047,957, 3,832,181 and 3,840,370; Japanese Unexamined Patent Publication Nos. 43319/1973, 63062/1975 and 127329/1977 and Japanese Patent Publication No. 32364/1973.

As the support for the inner latent image type light-sensitive material of the present invention, there may be employed, for example, baryta paper, polyethylene-coated paper, polypropylene synthetic paper, transparent supports provided with reflective layer or employing a reflective material in combination, such as glass plate, cellulose acetate, cellulose nitrate, polyester film such as polyethyleneterephthalate, etc., polyamide film, polycarbonate film, polystyrene film, etc. Further, conventional transparent supports may also be used, and these supports may be suitably selected depending on the purpose of use of the light-sensitive material.

For coating of the inner latent image type silver halide emulsion layer and other photographic constituent layers to be used in the present invention, it is possible to use various coating method such as dipping coating, air doctor coating, curtain coating, hopper coating, etc. Also, simultaneous coating of two or more layers can also be used as disclosed in U.S. Pat. Nos. 2,761,791 and 2,941,898.

In the present invention, the number and the coating positions of emulsion layers can be determined as desired. For example, in the case of a full color inner latent image light-sensitive material, it may consist of three emulsion layers of a blue-sensitive silver halide emulsion layer, a green-sensitive silver halide emulsion layer, and a red-sensitive silver halide emulsion layer, and each of these light-sensitive silver halide emulsion layers may also consist of two or more layers. And, the effect of the present invention is great when all of these light-sensitive emulsion layers consist substantially of a silver chlorobromide emulsion.

In the inner latent image type light-sensitive material of the present invention, intermediate layers with suitable thicknesses may be provided as desired depending on the purpose, and further various layers such as filter layer, curl prevention layer, protective layer, anti-halation layer, etc., can also be suitably used as constituent layers in combiantion. These constituent layers can be similarly used as the hydrophilic colloid which can be used in the emulsion layers as described above as the binder, and various additives for photography which can be contained in the emulsion layers as described above can also be contained therein.

In accordance with the present invention, there can be provided a rapid and stable method of processing an inner latent image type light-sensitive material for formation of direct positive image by use of a color developer containing the color developing agent of the present invention, which can maintain constantly adequate photographic performance over a long term without suffering from influence by the change in the bromide ion concentration even when processed with small amount of replenisher and is also little in generation of developing fog.

EXAMPLES

The present invention is described in more detail by referring to the following examples, by which the embodiments of the present invention are not limited.

EXAMPLE 1

On a paper support laminated with polyethylene, the respective layers shown below were successively provided by coating from the support side to prepare inner latent image type light-sensitive material samples Nos. 1 to 25.

First layer: cyan forming red-sensitive silver halide emulsion layer

To a solution prepared by mixing 80 g of 2,4-dichloro-3-methyl-6-[α-(2,4-di-tert-amylphenoxy)-butylamido]phenol as the cyan coupler, 2 g of 2,5-di-tert-octylhydroquinone, 100 g of dibutyl phthalate, 200 g of paraffin and 50 g of ethyl acetate was added a gelatin solution containing sodium dodecylbenzene sulfonate and an inner latent image type silver halide emulsion with a silver halide composition shown in Table 1 (prepared according to the conversion method as described in Example 1 disclosed in U.S. Pat. No. 2,592,250) dispersed with a mean grain size of 0.6 μm was added. The resultant coating composition was applied to a silver amount of 400 mg/m$^2$ and a coupler amount of 320 mg/m$^2$.

Second layer: intermediate layer

An amount of 100 ml of a 2.5% gelatin solution containing 5 g of gray colloidal silver and 10 g of 2.5-di-tert-octylhydroquinone dispersed in dibutyl phthalate was coated to a colloidal silver amount of 400 mg/m$^2$.

Third layer: magenta forming green-sensitive silver halide emulsion layer

To a solution prepared by mixing 100 g of a magenta coupler, 1-(2,4,6-trichlorophenyl)-3-(2-chloro-5-octadecylsuccinimidoanilino)-5-pyrazolone, 5 g of 2,5-di-tert-octylhydroquinone, 50 g of Sumilizer MDP (produced by Sumitomo Kagaku Kogyo K. K.), 200 g of paraffin, 100 g of dibutyl phthalate and 50 g of ethyl acetate was added a gelatin solution containing sodium dodecylbenzene sulfonate, and the inner latent image type silver halide emulsion with a silver halide composition shown in Table 1 prepared in the same manner as in the first layer dispersed to a mean grain size of 0.6 μm was added. The resultant composition was coated to a silver amount of 400 mg/m$^2$ and a coupler amount of 400 mg/m$^2$.

Fourth layer: yellow filter layer

A 2.5% gelatin solution containing 5 g of yellow colloidal silver and 5 g of 2,5-di-tert-octylhydroquinone dispersed in dibutyl phthalate was coated to a colloidal silver amount of 200 mg/m$^2$.

Fifth layer: yellow forming blue-sensitive silver halide emulsion layer

To a solution prepared by mixing 120 g of a yellow coupler, α-[4-(1-benzyl-2-phenyl-3,5-dioxo-1,2,4-triazolizinyl)]-αpivalyl-2-chloro-5-[γ-(2,4-di-tert-amylphenoxy)butylamido]acetoanilide, 3,5 g of 2,5-di-tert-octylhydroquinone, 200 g of paraffin, 100 g of Tinuvin (produced by Ciba Geigy Co.), 100 g of dibutyl phthalate and 70 ml of ethyl acetate was added a gelatin solution containing sodium dodecylbenzene sulfonate and the inner latent image type silver halide emulsion with a silver halide composition shown in Table 1 prepared in the same manner as in the first layer dispersed to a mean grain size of 0.9 μm was added. The resultant composition was coated to a silver amount of 400 mg/m$^2$ and a coupler amount of 400 mg/m$^2$.

Sixth layer: protective layer

Gelatin was coated to an amount of 200 mg/m$^2$.

In all of the above layers, bis(vinylsulfonylmethyl) ether as the film hardening agent and saponin as the coating aid were incorporated.

Each of the inner latent image type light-sensitive material samples Nos. 1 to 25 shown in Table 1 was exposed to light through an optical wedge and then processed according to the following steps.

| Processing steps (38° C.) | |
|---|---|
| Dipping (color developer) | 8 sec. |
| Color developing | 120 sec. |
| (The whole surface was subjected uniformly to exposure with light of 1 lux) | |
| Bleach-fixing | 60 sec. |
| Water washing | 60 sec. |
| Drying | 60 to 80 °C., 120 sec. |

The respective processing solutions had the compositions shown below.

| [Color forming developer] | |
|---|---|
| Pure water | 800 ml |
| Benzyl alcohol | 15 ml |

-continued

| [Color forming developer] | |
|---|---|
| Hydroxyamine sulfate | 2.0 g |
| Potassium bromide | 0.6 g |
| Sodium chloride | 1.0 g |
| Potassium sulfite | 2.0 g |
| Triethanolamine | 2.0 g |
| Color developing agent (as shown in TABLE 1) | 0.023 mol |
| 1-Hydroxyethylidene-1,1-diphosphonic acid (60% aqueous solution) | 1.5 ml |
| Magnesium chloride | 0.3 g |
| Potassium carbonate | 32 g |
| Kaycoll-PK-Conc (fluorescent brightner, produced by Shinnisso Kako K.K.) | 2 g |

(made up to one liter with addition of pure water and adjusted to pH=10.1 with 20% potassium hydroxide or 10% dil. sulfuric acid)

| [Bleach-fixing solution] | |
|---|---|
| Pure water | 550 ml |
| Iron (III) ammonium ethylenediaminetetraacetate | 65 g |
| Ammonium thiosulfate (70% aqueous solution) | 85 g |
| Sodium hydrogen sulfite | 10 g |
| Sodium metabisulfite | 2 g |
| Disodium ethylenediaminetetraacetate | 20 g |

(made up to one liter with addition of pure water and adjusted to pH=7.0 with ammonia water or dil. sulfuric acid)

Separately, by use of the same color developer as described above except for changing the potassium bromide solution as 0.6 g/liter to 1.5 g/liter and 3.5 g/liter, each of the above samples Nos. 1 to 25 was subjected to developing processing.

Sensitometry was performed in a conventional manner for each of the samples obtained. The maximum density of the yellow dye of each sample (Dmax) when the potassium bromide concentration is 0.6 g/liter is defined as 100, and fluctuations in density when the potassium bromide concentration was varied are shown in Table 1. However, in all of the samples Nos. 13 to 25, development was completed within the color developing time of 120 seconds, but the color developing time was prolonged until development was completed for those of the samples No. 1 to No. 12 in which development was not completed within 120 seconds.

Color developing agent for control

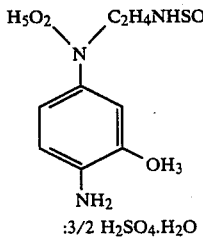

[CD-3]

-continued

Color developing agent for control

[CD-6]

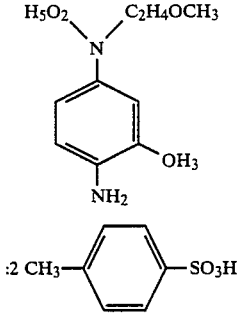

TABLE 1

| Sample No. | Silver halide composition: Red-sensitive emulsion layer I | Br | Cl | Green-sensitive emulsion layer I | Br | Cl | Blue-sensitive emulsion layer I | Br | Cl |
|---|---|---|---|---|---|---|---|---|---|
| 1 | 0.5 | 59.5 | 40 | 1 | 54 | 45 | 15 | 85 | — |
| 2 | 0.5 | 69.5 | 30 | 1 | 69 | 30 | 10 | 90 | — |
| 3 | 8 | 92 | — | 8 | 92 | — | 8 | 92 | — |
| 4 | 0.5 | 49.5 | 50 | 0.5 | 69.5 | 30 | 3 | 97 | — |
| 5 | 0.5 | 59.5 | 40— | 0.5 | 69.5 | 30 | 1 | 99 | — |
| 6 | 0.5 | 59.5 | 40 | 0.5 | 69.5 | 30 | 0.5 | 99.5 | — |
| 7 | 0.5 | 69.5 | 30 | 0.5 | 69.5 | 30 | — | 100 | — |
| 8 | 0.5 | 69.5 | 30 | 1 | 49 | 50 | 8 | 82 | 10 |
| 9 | 0.5 | 69.5 | 30 | 0.5 | 39.5 | 60 | 3 | 87 | 10 |
| 10 | 0.5 | 89.5 | 10 | 0.5 | 89.5 | 10 | 1 | 89 | 10 |
| 11 | 0.5 | 89.5 | 10 | 0.5 | 89.5 | 10 | 0.5 | 9.5 | 90 |
| 12 | 0.5 | 79.5 | 20 | 0.5 | 79.5 | 20 | — | — | 100 |
| 13 | — | 92 | 8 | — | 92 | 8 | — | 97 | 3 |
| 14 | — | 92 | 8 | — | 92 | 8 | — | 92 | 8 |
| 15 | — | 92 | 8 | — | 92 | 8 | — | 90 | 10 |
| 16 | — | 92 | 8 | — | 92 | 8 | — | 80 | 20 |
| 17 | — | 70 | 30 | — | 70 | 30 | — | 70 | 30 |
| 18 | 0.1 | 69.9 | 30 | 0.1 | 39.9 | 60 | — | 60 | 40 |
| 19 | — | 60 | 40 | — | 50 | 50 | — | 50 | 50 |
| 20 | — | 60 | 40 | — | 45 | 55 | — | 40 | 60 |
| 21 | — | 60 | 40 | — | 80 | 20 | — | 30 | 70 |
| 22 | 0.1 | 59.9 | 40 | 0.1 | 59.9 | 40 | 1 | 89.9 | 10 |
| 23 | 0.1 | 59.9 | 40 | 3 | 57 | 40 | 0.1 | 89.9 | 10 |
| 24 | 0.1 | 59.9 | 40 | 0.1 | 69.9 | 30 | 0.1 | 69.9 | 30 |
| 25 | 0.1 | 59.9 | 40 | 0.1 | 64.9 | 35 | 0.1 | 49.9 | 50 |

| Sample No. | Maximum yellow dye density (Dmax): Developing agent CD-3 KBr density 0.6 | 1.5 | 3.5 | Developing agent CD-6 KBr density 0.6 | 1.5 | 3.5 | Sulfate of Exe. Comp. (1) KBr Density 0.6 | 1.5 | 3.5 | Sulfate of Exe. Comp. (2) KBr density 0.6 | 1.5 | 3.5 |
|---|---|---|---|---|---|---|---|---|---|---|---|---|
| 1 | 100 | 74 | 61 | 100 | 77 | 64 | 100 | 76 | 61 | 100 | 75 | 63 |
| 2 | 100 | 72 | 57 | 100 | 77 | 62 | 100 | 74 | 60 | 100 | 73 | 59 |
| 3 | 100 | 68 | 53 | 100 | 72 | 54 | 100 | 69 | 55 | 100 | 71 | 54 |
| 4 | 100 | 64 | 48 | 100 | 71 | 53 | 100 | 67 | 49 | 100 | 68 | 49 |
| 5 | 100 | 53 | 39 | 100 | 62 | 45 | 100 | 59 | 42 | 100 | 55 | 43 |
| 6 | 100 | 49 | 29 | 100 | 57 | 39 | 100 | 53 | 33 | 100 | 52 | 30 |
| 7 | 100 | 45 | 23 | 100 | 51 | 29 | 100 | 46 | 27 | 100 | 48 | 28 |
| 8 | 100 | 83 | 71 | 100 | 84 | 73 | 100 | 83 | 71 | 100 | 83 | 72 |
| 9 | 100 | 82 | 69 | 100 | 85 | 73 | 100 | 84 | 71 | 100 | 84 | 68 |
| 10 | 100 | 82 | 72 | 100 | 84 | 74 | 100 | 82 | 73 | 100 | 83 | 73 |
| 11 | 100 | 45 | 25 | 100 | 49 | 32 | 100 | 46 | 27 | 100 | 47 | 29 |
| 12 | 100 | 41 | 21 | 100 | 47 | 28 | 100 | 45 | 25 | 100 | 44 | 22 |
| 13 | 100 | 84 | 71 | 100 | 84 | 72 | 100 | 91 | 86 | 100 | 89 | 81 |
| 14 | 100 | 85 | 69 | 100 | 85 | 71 | 100 | 91 | 87 | 100 | 89 | 81 |
| 15 | 100 | 84 | 65 | 100 | 85 | 71 | 100 | 95 | 94 | 100 | 92 | 86 |
| 16 | 100 | 83 | 64 | 100 | 84 | 69 | 100 | 96 | 94 | 100 | 92 | 86 |
| 17 | 100 | 79 | 62 | 100 | 81 | 67 | 100 | 99 | 98 | 100 | 95 | 93 |
| 18 | 100 | 81 | 69 | 100 | 83 | 70 | 100 | 99 | 99 | 100 | 94 | 92 |
| 19 | 100 | 76 | 59 | 100 | 78 | 62 | 100 | 99 | 99 | 100 | 95 | 93 |
| 20 | 100 | 73 | 55 | 100 | 79 | 58 | 100 | 98 | 97 | 100 | 94 | 92 |
| 21 | 100 | 69 | 55 | 100 | 75 | 58 | 100 | 97 | 96 | 100 | 93 | 91 |
| 22 | 100 | 83 | 67 | 100 | 85 | 70 | 100 | 96 | 96 | 100 | 93 | 91 |
| 23 | 100 | 79 | 65 | 100 | 81 | 69 | 100 | 91 | 86 | 100 | 89 | 81 |
| 24 | 100 | 74 | 59 | 100 | 77 | 59 | 100 | 98 | 96 | 100 | 94 | 90 |
| 25 | 100 | 72 | 55 | 100 | 75 | 57 | 100 | 98 | 96 | 100 | 94 | 91 |

As is also apparent from the result shown in Table 1, as compared with the case of samples No. 1 to No. 12 when the silver halide is not substantially silver chlorobromide, in the case of samples No. 13 to No. 25 when the silver halide is substantially silver chlorobromide and the color developing agent is the exemplary compound (1) or (2) of the present invention, no appreciable change in color forming density can be seen even when the bromide ion concentration in the color developer may be changed as 0.6 g/liter, 1.5 g/liter and 3.5 g/liter, thus exhibiting high processing stability. In contrast, in the case of the color developing agents CD-3 or CD-6 which have been known in the art, regardless of the composition of silver halide, the color forming density will be disadvantageously lowered corresponding to the increase in the bromide ion concentration in the color forming developer in any case. Since Table 1 shows treatment with less amount replenished as the bromide ion concentration is higher, it is shown that the amount to be replenished can be markedly reduced according to the processing of the present invention.

EXAMPLE 2

In the same manner as in Example 1, inner latent image type light-sensitive material samples Nos. 26 to 50 were prepared in which silver halide compositions were varied. However, in this example, the mean grain sizes in the cyan forming red-sensitive silver halide emulsion layer, the magenta forming green-sensitive silver halide emulsion layer and the yellow forming blue-sensitive silver halide emulsion layer were changed to 0.8 μm, 0.8 μm and 1.5 μm, respectively, and 2,4-dichloro-6-hydroxy-S-triazine sodium as the film hardening agent was added in the second, fourth and sixth layers in an amount of 0.02 g per g of gelatin, respectively. After drying, the gelatin film swelling speed $T_{\frac{1}{2}}$ was measured at 30° C. by use of the color developer shown below to be about 7 seconds. Measurement was conducted by use of a Levenson type swelling meter.

After processing according to the same processing steps with the same processing solutions as in Example 1, evaluation was conducted similarly as in Example 1. As a result, substantially the same results as Example 1 were obtained.

EXAMPLE 3

In the same manner as in Example 1, inner latent image type light-sensitive materials samples Nos. 51 to 75 were prepared in which silver halide emulsion composition were varied. However, in this example, the cyan coupler was changed to the exemplary cyan coupler (C-111).

After processing according to the same processing steps with the same processing solutions as used in Example 1, evaluation was conducted similarly as Example 1 to obtain substantially the same results as in Example 1. When the same experiments were repeated by use of the exemplary compounds (C-86) and (C-101) in place of the exemplary compound (C-111), respectively, substantially the same results could be obtained.

EXAMPLE 4

By use of the inner latent image type light-sensitive material sample No. 17 of Example 1, exposure and developing processing were effected similarly as in Example 1 with the use of the same processing solution. The color developer was prepared by changing the color developing agent to those as shown in Table 2 and controlling the potassium bromide concentration to 1.5 g/liter and provided for processing. The color developing time was changed as shown in Table 2. The processing temperature was 38° C. The minimum densities of the yellow dye in the samples obtained (Dmin) were measured and shown in Table 2.

TABLE 2

| Color developing time (seconds) (at 38° C.) | Minimum yellow dye density (Dmin) CD-3 | CD-6 | Sulfate of Exemplary comp. (1) | Sulfate of Exemplary comp. (2) | Remarks |
|---|---|---|---|---|---|
| 300 | 0.05 | 0.07 | 0.24 | 0.22 | Control |
| 270 | 0.05 | 0.06 | 0.21 | 0.22 | |
| 240 | 0.05 | 0.06 | 0.21 | 0.20 | |
| 210 | 0.04 | 0.06 | 0.20 | 0.19 | |
| 180 | 0.04 | 0.05 | 0.19 | 0.19 | |
| 150 | 0.03 | 0.05 | 0.09 | 0.10 | |
| 120 | 0.03 | 0.05 | 0.06 | 0.06 | |
| 90 | 0.03 | 0.04 | 0.03 | 0.04 | This Invention |
| 60 | 0.03 | 0.04 | 0.03 | 0.04 | |
| 30 | 0.03 | 0.04 | 0.03 | 0.04 | |
| 15 | 0.03 | 0.04 | 0.03 | 0.04 | |

As is also apparent from the results in Table 2, when CD-3 or CD-6 is employed as the color developing agent in the color developer, no great difference in minimum density can be recognized regardless of the color developing time.

On the other hand, in the case of the exemplary compound (1) or (2) of the color developing agent of the present invention, the minimum density is remarkably high when the color developing processing time is 180 seconds or longer. Whereas, when the color developing time is 150 seconds or shorter, developing fogging can be abruptly improved to give preferable results similarly as the case of using the above CD-3.

EXAMPLE 5

When the same processing as in Example 4 was repeated by use of the inner latent image light-sensitive material No. 42 of Example 2, substantially the same results were obtained.

EXAMPLE 6

When the same processing as in Example 4 was repeated by use of the inner latent image type light-sensitive material No. 67 of Example 3, substantially the same results as in Example 4 were obtained also in this case.

EXAMPLE 7

By using silver halides of samples No. 3 and No. 17 of Example 1, respectively, samples were prepared in which the mean grain size of silver halide grains in the blue-sensitive emulsion layer was varied as in Table 3. These samples were given the same exposure as in Example 1 and processed with the same processing solutions as used in Example 1. The color developer was prepared by varying the color developing agent as shown in Table 3 and controlling the potassium bromide concentration to 1.5 g/liter. The maximum density of yellow dye when color developed at 38° C. for 10 minutes was defined as 100 and the processing time necessary before the maximum density becomes 80 (developing convergence time) and the minimum yellow dye density at that time is shown in Table 3. These results show the relationship between the mean grain size and rapidness of development.

TABLE 3

| | Color developing agent | Developing convergence time (seconds) mean grain size (μm) 2.0 | 1.5 | 1.4 | 1.1 | 1.0 | 0.6 | Minimum yellow density (Dmin) mean grain size (μm) 2.0 | 1.5 | 1.4 | 1.1 | 1.0 | 0.6 | Remarks |
|---|---|---|---|---|---|---|---|---|---|---|---|---|---|---|
| Control AgBrCl 70/30 | CD-3 | 178 | 152 | 149 | 132 | 130 | 128 | 0.04 | 0.03 | 0.03 | 0.03 | 0.03 | 0.03 | Silver chlorobromide |
| | CD-6 | 165 | 148 | 144 | 121 | 119 | 113 | 0.05 | 0.05 | 0.05 | 0.05 | 0.05 | 0.05 | |
| This invention AgBrCl 70/30 | Sulfate of Exemp. Comp. (1) | 182 | 158 | 118 | 98 | 53 | 38 | 0.19 | 0.16 | 0.06 | 0.05 | 0.03 | 0.03 | |
| | Sulfate of Exemp. Comp. (2) | 189 | 179 | 137 | 112 | 72 | 58 | 0.19 | 0.19 | 0.09 | 0.06 | 0.04 | 0.04 | |
| | Sulfate of Exemp. Comp. (6) | 190 | 185 | 142 | 125 | 83 | 61 | 0.20 | 0.19 | 0.09 | 0.09 | 0.04 | 0.04 | |
| Control AgBrCl 92/8 | CD-3 | 230 | 200 | 198 | 178 | 169 | 156 | 0.03 | 0.03 | 0.03 | 0.03 | 0.03 | 0.03 | Silver iodobromide |
| | CD-6 | 211 | 183 | 179 | 158 | 149 | 132 | 0.04 | 0.04 | 0.04 | 0.04 | 0.04 | 0.04 | |
| | Sulfate of Exemp. Comp. (1) | 263 | 202 | 199 | 154 | 149 | 113 | 0.06 | 0.05 | 0.05 | 0.04 | 0.04 | 0.03 | |
| | Sulfate of Exemp. Comp. (2) | 278 | 213 | 208 | 162 | 155 | 131 | 0.08 | 0.07 | 0.07 | 0.05 | 0.04 | 0.03 | |
| | Sulfate of Exemp. Comp. (6) | 280 | 218 | 214 | 168 | 161 | 138 | 0.08 | 0.07 | 0.07 | 0.05 | 0.04 | 0.03 | |

As is also apparent from the results in Table 3, in the case when the silver halide is silver chlorobromide, if the color developing agent is that of the present invention and has a mean grain size of 1.4 μm, an extremely rapid development convergence (reaching) time is exhibited, thus enabling rapid developing processing with low developing fog. On the other hand, even when the color developing agent of the present invention may be used, if the main grain size is 1.5 μm or more, the developing convenrgence (reaching) time becomes abruptly longer and also development fog becomes higher. Further, when the color developing agent is outside the present invention, no rapid developing convergence (reaching) time could be obtained even when the mean grain size may be smaller.

On the other hand, in the case when the silver halide is substantially silver iodobromide, even when the color developing agent may be that of the present invention, no rapid developing convergence (reaching) time can be obtained regardless of the size of mean grain size.

EXAMPLE 8

By using the silver halides of samples No. 28 and No. 42 of Example 2, respectively, and using the silver halide amounts at the same levels of coated silver amounts in blue, green and red-sensitive emulsion layers in Example 2, samples with various amounts of film hardening agents added were prepared. For the samples after drying, by use of the above color developer (measurement processing temperature 30° C.), the film swelling speed $T\frac{1}{2}$ was measured by means of a Levenson type swelling meter. The samples of which the film swelling speed $T\frac{1}{2}$ were 2, 5, 10, 15, 30, 40, 60, 90, 120 seconds were selected and used for experiments. These samples were given the same exposure as in Example 1 and processed with the same processing solutions as used in Example 1. The color developer was prepared by changing the color developing agent as shown in Table 4 and controlling the potassium bromide concentration to 1.5 g/liter. The maximum density of yellow dye when color developed at 38° C. for 10 minutes was defined as 100 and the processing time necessary before the maximum density becomes 80 (developing convergence time) was shown in Table 4. These results show the relationship between the film swelling speed $T\frac{1}{2}$ and rapidness of developement.

(reaching) time is exhibited, thus enabling rapid developing processing. On the other hand, even when the color developing agent may be that of the present invention, if the film swelling speed $T\frac{1}{2}$ is 40 seconds or longer, the developing convergence (reaching) time becomes abruptly longer. Also, when the color developing agent is outside the scope of the present invention, even when the film swelling speed $T\frac{1}{2}$ may be very small, no rapid developing convergence (reaching) time could be obtained.

On the other hand, when the silver halide is substantially silver iodobromide, even if the color developing agent may be that of the present invention and the amount of silver coated in the blue-sensitive emulsion layer may be within the range of the present invention, no rapid developing convergence (reaching) time could be obtained regardless of the film swelling speed $T\frac{1}{2}$.

EXAMPLE 9

By using the silver halides of samples No. 28 and No. 42 in Example 2, samples were prepared by coating so that the amount of silver in the blue-sensitive emulsion layer was 0.2 g/m², 0.4 g/m², 0.6 g/m², 0.8 g/m², 1.0 g/m², 1.2 g/m², 2 g/m², 3 g/m². The film swelling speed $T\frac{1}{2}$ of each sample (measured at processing temperature 30° C.) was 7 seconds. The coupler was used when the amount in Example 2 was 1.4 g/m², and the silver amount ratio was changed in other cases. The same processing solution as used in Example 1 except for varying the color developing agent was used.

The bromide ion concentration was made 1.5 g/liter of potassium bromide. The maximum density of yellow dye when color developed with a color developing solution at 38° C. for 10 minutes was defined as 100, and the processing time necessary before the maximum density became 80 was measured and shown in Table 5. This time shows the developing convergence time similarly as in Example 8.

TABLE 4

| | Color developing agent | Film swelling speed $T\frac{1}{2}$(seconds) 2 | 5 | 7 | 10 | 15 | 20 | 30 | 40 | 60 | 90 | 120 | Remarks |
|---|---|---|---|---|---|---|---|---|---|---|---|---|---|
| Control AgBrCl 70/30 | CD-3 | 121 | 126 | 128 | 131 | 133 | 141 | 156 | 176 | 186 | 191 | 196 | Silver chlorobromide |
| | CD-6 | 107 | 107 | 118 | 119 | 123 | 134 | 142 | 151 | 158 | 161 | 162 | |
| This invention AgBrCl 70/30 | Sulfate of Exemp. Comp. (1) | 35 | 37 | 41 | 55 | 62 | 71 | 105 | 185 | 214 | 251 | 291 | |
| | Sulfate of Exemp. Comp. (2) | 43 | 46 | 49 | 65 | 71 | 81 | 113 | 194 | 221 | 253 | 289 | |
| | Sulfate of Exemp. Comp. (6) | 44 | 47 | 51 | 64 | 73 | 82 | 115 | 193 | 223 | 252 | 287 | |
| Control AgBrCl 92/8 | CD-3 | 154 | 156 | 163 | 169 | 174 | 190 | 192 | 198 | 210 | 213 | 215 | Silver iodebromide |
| | CD-6 | 131 | 127 | 131 | 144 | 157 | 168 | 170 | 172 | 173 | 173 | 174 | |
| | Sulfate of Exemp. Comp. (1) | 115 | 117 | 122 | 126 | 131 | 134 | 145 | 157 | 168 | 193 | 225 | |
| | Sulfate of Exemp. Comp. (2) | 140 | 141 | 159 | 160 | 163 | 170 | 176 | 189 | 219 | 235 | 258 | |
| | Sulfate of Exemp. Comp. (6) | 141 | 143 | 145 | 158 | 159 | 168 | 172 | 191 | 217 | 238 | 260 | |

As is also apparent from the results in Table 4, in the case when the silver halide is silver chlorobromide, if the color developing agent is that of the present invention and the film swelling speed $T\frac{1}{2}$ is 30 seconds or shorter, an extremely rapid developing convergence

TABLE 5

| | Ag amount (g/m²) | 0.2 | 0.4 | 0.6 | 0.8 | 1 | 1.2 | 2 | 3 |
|---|---|---|---|---|---|---|---|---|---|
| Control AgBrCl 70/30 | CD-3 | 124 | 128 | 143 | 161 | 183 | 184 | 187 | 193 |
| | CD-6 | 111 | 118 | 138 | 158 | 174 | 176 | 178 | 182 |
| This invention AgBrCl 70/30 | Sulfate of Exemplary compound (1) | 39 | 41 | 51 | 72 | 93 | 156 | 163 | 206 |
| | Sulfate of Exemplary compound (2) | 47 | 49 | 58 | 78 | 98 | 161 | 176 | 218 |
| Control | CD-3 | 156 | 163 | 172 | 183 | 194 | 196 | 200 | 215 |

TABLE 5-continued

| | Ag amount (g/m²) | 0.2 | 0.4 | 0.6 | 0.8 | 1 | 1.2 | 2 | 3 |
|---|---|---|---|---|---|---|---|---|---|
| AgBrI 92/8 | CD-6 | 125 | 131 | 142 | 153 | 167 | 168 | 181 | 193 |
| | Sulfate of Exemplary compound (1) | 119 | 122 | 143 | 168 | 189 | 192 | 207 | 221 |
| | Sulfate of Exemplary compound (2) | 158 | 159 | 178 | 196 | 215 | 216 | 218 | 224 |

As is also apparent from the results in Table 5, in the case when the silver halide is silver chlorobromide, if the color developing agent is that of the present invention, the film swelling speed is within the range of the present invention and the amount of the silver coated in the blue-sensitive emulsion layer is 1 g/m² or lower, an extremely rapid developing convergence (reaching) time is exhibited, thus enabling rapid developing processing. On the other hand, even when the color developing agent may be that of the present invention, if the amount of silver coated in the blue-sensitive emulsion layer exceeds 1 g/m², the developing convergence (reaching) time will be abruptly prolonged, while when the color developing agent is outside of the scope of the present invention, no rapid developing convergence (reaching) time could be obtained even if the silver amount may be small.

On the other hand, in the case when the silver halide is substantially silver iodobromide, even if the color developing agent may be that of the present invention and the film swelling speed may be within the range of the present invention, no rapid developing convergence (reaching) time could be obtained.

Also, the same experiments were conducted with the use of the silver halide of No. 42, with an amount of silver coated of 1 g/m² in the blue-sensitive emulsion layer and various silver amounts coated in green-sensitive and red-sensitive emultion layers. As the result, it was found that the most rapid developing convergence (reaching) time could be exhibited when the amount of silver coated in all the light-sensitive emulsion layers were 1 g/m² or less.

EXAMPLE 10

By using the silver halides of samples No. 53 and No. 67 in Example 3, samples with various mean grain sizes of silver halide grains in the blue-sensitive emulsion layer were prepared in the same manner as in Example 7 and the same experiments as in Example 7 were repeated. As a result, substantially the same results as in Example 7 were obtained. Also, by use of the Exemplary compounds (C-29) and (C-36) of the present invention in place of the Exemplary compound (C-111) of the present invention as the cyan coupler, the same experiments were repeated respectively, and substantially the same results could be obtained.

EXAMPLE 11

By use of the samples No. 3 and No. 17 in Example 1, the concentrations of color developing agents and potassium bromide in the color developer were varied similarly as in Example 1. The maximum density of yellow dye of each sample at the potassium bromide concentration of 0.6 g/liter (Dmax) was defined as 100, and fluctuations in density when the potassium bromide concentration was varied were shown in Table 6.

However, fogging treatment was performed by addition of 1-acetyl-2-phenylhydradine [fogging agent(1)] or 1-formyl-2-(4-methylphenyl)hydradine [fogging agent (2)] as the fogging agent during color development in place of giving the whole surface exposure and controlling the pH of color developer to 12.

TABLE 6

| | Fogging treatment | Light fogging | | | Fogging agent (1) | | | Fogging agent (2) | | |
|---|---|---|---|---|---|---|---|---|---|---|
| | KBr amount (g/m²) | 0.6 | 1.5 | 3.5 | 0.6 | 1.5 | 3.5 | 0.6 | 1.5 | 3.5 |
| Control AgBrCl 70/30 | CD-3 | 100 | 79 | 62 | 100 | 78 | 60 | 100 | 77 | 61 |
| | CD-6 | 100 | 81 | 67 | 100 | 79 | 68 | 100 | 79 | 70 |
| This invention AgBrCl 70/30 | Sulfate of Exemplary compound (1) | 100 | 99 | 98 | 100 | 93 | 88 | 100 | 92 | 86 |
| | Sulfate of Exemplary compound (2) | 100 | 95 | 93 | 100 | 90 | 84 | 100 | 91 | 84 |
| Control AgBrI 92/8 | CD-3 | 100 | 68 | 53 | 100 | 67 | 52 | 100 | 66 | 53 |
| | CD-6 | 100 | 72 | 54 | 100 | 69 | 51 | 100 | 68 | 56 |
| | Sulfate of Exemplary compound (1) | 100 | 69 | 55 | 100 | 68 | 56 | 100 | 68 | 49 |
| | Sulfate of Exemplary compound (2) | 100 | 71 | 54 | 100 | 69 | 53 | 100 | 69 | 51 |

As is also apparent from the results in Table 6, even in processing of the present invention, the effect of the bromide ion concentration can be smaller when applied with light fogging treatment.

EXAMPLE 12

When the same experiments as in Example 11 were repeated by use of the samples No. 28 and No. 42 in Example 2, substantially the same results as in Example 11 were obtained.

EXAMPLE 13

When the same experiments as in Example 11 were repeated by use of the samples No. 53 and No. 67 in Example 3, substantially the same results as in Example 11 were obtained.

EXAMPLE 14

By use of the silver halide of sample No. 67 in Example 3, samples were prepared by varying the cyan coupler as shown in Table 7. These samples were processed under the same conditions as in Example 1 with the same processing solutions as used in Example 1. The color developing solution was prepared by varying the color developing agent as shown in Table 7 and controlling the potassium bromide concentration to 1.5 g/liter.

Then, the respective color developing solutions were transferred into Erlenmeyer's flasks and stored at 50° C. for 2 weeks while supplying water as desired. After storage, by use of these color developing solutions, the same processings performed as before storage were repeated.

The maximum density of the cyan dye of the samples obtained (Dmax) was measured and the fluctuations in density when processed with the color developing solution after storage were measured with maximum density of cyan dye processed with the color developing solution before storage as being 100 to obtain the results shown in Table 7.

TABLE 7

| | Color developing agent | | | | | |
|---|---|---|---|---|---|---|
| | Maximum cyan dye density after storage (Dmax) | | | | | |
| Cyan coupler | CD-3 | CD-6 | Sulfate of Exemplary comp. (1) | Sulfate of Exemplary comp. (2) | Sulfate of Exemplary comp. (6) | Remarks |
| Control coupler (1)* | 70 | 73 | 74 | 74 | 75 | Control |
| Control coupler (2)* | 68 | 71 | 69 | 72 | 73 | |
| Control coupler (3)* | 66 | 68 | 67 | 68 | 68 | |
| Exemplary couplor C-2 | 69 | 71 | 94 | 93 | 93 | This |
| Exemplary couplor C-8 | 68 | 69 | 93 | 92 | 91 | Invention |
| Exemplary couplor C-14 | 70 | 71 | 94 | 94 | 93 | |
| Exemplary couplor C-86 | 72 | 74 | 99 | 98 | 98 | |
| Exemplary couplor C-101 | 71 | 72 | 99 | 99 | 99 | |
| Exemplary couplor C-111 | 73 | 73 | 99 | 98 | 99 | |
| Exemplary couplor C-29 | 70 | 71 | 97 | 96 | 95 | |
| Exemplary couplor C-36 | 69 | 70 | 96 | 94 | 94 | |
| Exemplary couplor C-56 | 69 | 71 | 96 | 95 | 96 | |

*Control coupler (1)

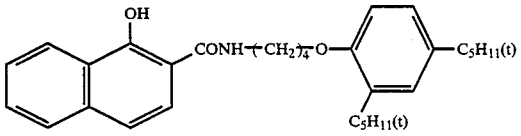

*Control coupler (2)

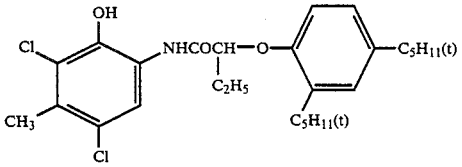

*Control coupler (3)

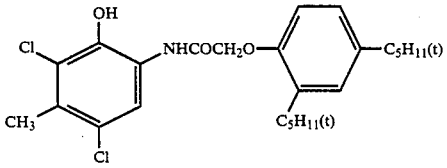

As is also apparent from the results shown in Table 7, in the case of cyan coupler outside the present invention, the maximum density of cyan dye after storage will be lowered even when the color developing agent of the present invention may be used. However, when the cyan coupler of the present invention is used and the color developing agent of the present invention is used, lowering of the maximum density of cyan dye after storage can be effectively prevented.

EXAMPLE 15

Of the color developing solutions prepared and stored in Example 14, the color developing solution using the sulfate of the exemplary compound (1) was used as the color developing agent for processing of the sample used in Example 14. Here, the color developing time was changed as shown in Table 8 and the maximum density of cyan dye of the samples obtained (Dmax) was measured to obtain the results shown in Table 8.

TABLE 8

| Color | Maximum cyan dye density (Dmax) | | | | | |
|---|---|---|---|---|---|---|
| developing time (seconds) | Control coupler (1) | Control coupler (2) | Control coupler (3) | Exemplary coupler C-2 | Exemplary coupler C-8 | Exemplary coupler C-14 |
| 300 | 2.95 | 2.94 | 2.93 | 2.94 | 2.94 | 2.95 |
| 270 | 2.94 | 2.94 | 2.93 | 2.94 | 2.94 | 2.94 |
| 240 | 2.94 | 2.94 | 2.93 | 2.93 | 2.94 | 2.94 |
| 210 | 2.93 | 2.92 | 2.91 | 2.93 | 2.93 | 2.93 |
| 180 | 2.86 | 2.85 | 2.85 | 2.87 | 2.86 | 2.85 |
| 150 | 2.43 | 2.41 | 2.41 | 2.81 | 2.79 | 2.81 |
| 120 | 2.18 | 2.032 | 1.96 | 2.76 | 2.73 | 2.77 |

TABLE 8-continued

| | | | | | | |
|---|---|---|---|---|---|---|
| 90 | 1.83 | 1.87 | 1.81 | 2.66 | 2.64 | 2.63 |
| 60 | 1.40 | 1.37 | 1.39 | 2.52 | 2.51 | 2.49 |
| 30 | 1.01 | 1.04 | 1.02 | 2.35 | 2.36 | 2.41 |
| 15 | 0.41 | 0.36 | 0.39 | 1.42 | 1.39 | 1.37 |

| Color developing time (seconds) | Maximum cyan dye density (Dmax) | | | | | |
|---|---|---|---|---|---|---|
| | Exemplary coupler C-86 | Exemplary coupler C-101 | Exemplary coupler C-111 | Exemplary coupler C-29 | Exemplary coupler C-36 | Exemplary coupler C-56 |
| 300 | 2.95 | 2.94 | 2.93 | 2.93 | 2.94 | 2.94 |
| 270 | 2.94 | 2.94 | 2.93 | 2.93 | 2.94 | 2.94 |
| 240 | 2.94 | 2.93 | 2.93 | 2.93 | 2.93 | 2.93 |
| 210 | 2.93 | 2.93 | 2.93 | 2.93 | 2.93 | 2.92 |
| 180 | 2.93 | 2.92 | 2.92 | 2.90 | 2.91 | 2.90 |
| 150 | 2.93 | 2.92 | 2.91 | 2.86 | 2.86 | 2.86 |
| 120 | 2.92 | 2.91 | 2.90 | 2.84 | 2.82 | 2.82 |
| 90 | 2.84 | 2.81 | 2.83 | 2.70 | 2.69 | 2.71 |
| 60 | 2.71 | 2.69 | 2.72 | 2.61 | 2.60 | 2.62 |
| 30 | 2.67 | 2.60 | 2.66 | 2.45 | 2.46 | 2.44 |
| 15 | 1.68 | 1.70 | 1.66 | 1.53 | 1.55 | 1.52 |

*These experiments were carried out at 38° C.

As is also apparent from the results shown in Table 8, in the samples where control cyan couplers outside of the present invention are employed, lowering in cyan dye density is marked when treated for a short time of 150 seconds or shorter, but in the samples employing the cyan coupler of the present invention lowering in cyan dye density when treated for a short period of 150 seconds or shorter is very small.

We claim:

1. A method for forming a direct positive color image by subjecting an inner latent image type light-sensitive silver halide color photographic material for formation of a direct positive color image, having at least one light-sensitive emulsion layer containing inner latent image type silver halide grains which have not been previously fogged on the grain surfaces to color developing processing after image exposure, which comprises developing, an inner latent image type light-sensitive silver halide color photographic material for formation of a direct positive color image in which a silver halide emulsion, in at least one light-sensitive emulsion layer consists substantially of a silver chlorobromide emulsion by contact with a color developing solution having a pH of 7 to 13 and containing a N-hydroxyalkyl-substituted-p-phenylenediamine derivative as a color developing agent in an amount of 1 to 100 g/l of said color developing solution at 30° C. to 50° C. for from 5 to 150 seconds.

2. The method according to claim 1, wherein said N-hydroxyalalkyl-substituted-p-phenylenediamine derivative is a quaternary ammonium salt of a N-hydroxyalkyl-substituted-p-phenylenediamine compound having the following formula:

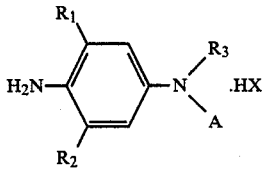

wherein $R_1$ is a hydrogen atom, an alkyl group having 1 to 4 carbon atoms or an alkoxy group having 1 to 4 carbon atoms; $R_2$ is a hydrogen atom or an alkyl group having 1 to 4 carbon atoms; $R_3$ is an alkyl group having 1 to 4 carbon atoms or such an alkyl group having a hydroxyl substituent; A is an alkyl group which has at least one hydroxyl group; and HX is hydrochloric acid, sulfuric acid, p-toluenesulfonic acid, nitric acid or phosphoric acid.

3. The method according to claim 2, wherein said mean grain size of the silver halide grains is 0.6 to 1.4 μm.

4. The method according to claim 3, wherein said mean grain size of the silver halide grains is 1.0 μm or less.

5. The method according to claim 2, wherein the amount of silver in the silver halide coated on or contained in the blue-sensitive emulsion layer in the inner latent image type light-sensitive silver halide color photographic material is 0.2 to 1 g/m$^2$ and the film swelling speed $T\frac{1}{2}$ of a binder is 2 to 30 seconds.

6. The method according to claim 2, wherein a red-sensitive emulsion layer in the inner latent image type light-sensitive silver halide color photographic material contains at least one of cyan couplers represented by the following formulae (I), (II) and (III):

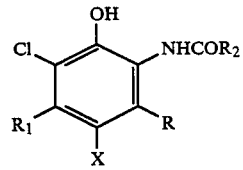

(I)

wherein one of R and $R_1$ represents a hydrogen atom and the other represents a straight or branched alkyl group having 2 to 12 carbon atoms; X represents a hydrogen atom or an eliminable group through the coupling reaction with the oxidized product of the N-hydroxyalkyl-substituted-p-phenylenediamine derivative contained in the color developing solution; and $R_2$ represents a balast group,

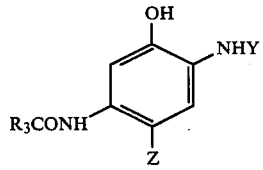

[II]

wherein Y represents

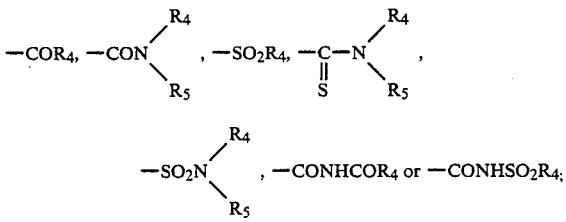

wherein $R_4$ represents an alkyl group, an alkenyl group, a cycloalkyl group, an aryl group or a hetero cyclic group; $R_5$ represents a hydrogen atom, an alkyl group, an alkenyl group, a cycloalkyl group, an aryl group or heterocyclic group; $R_4$ and $R_5$ may be bonded each other and form 5- or 6-membered heterocyclic ring; $R_3$ represents a balast group; Z represents a hydrogen atom or an eliminable group through the coupling reaction with the oxidized product of the N-hydroxyalkyl-substituted-p-phenylenediamine derivative contained in the color developing solution,

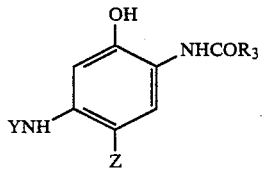

[III]

wherein Y, $R_3$, Z, $R_4$ and $R_5$ are as defined in formula (II).

7. The method according to claim 2, wherein the inner latent image type light-sensitive silver halide color photographic material for formation of direct positive color image which has been subjected to image exposure is subjected to at least one of developing processing carried out after applying whole exposure for fogging treatment and developing processing carried out while applying whole exposure for fogging treatment.

8. The method according to claim 2, wherein a silver halide emulsion contained in at least one light-sensitive emulsion layer is a silver chlorobromide emulsion containing silver bromide in an amount of 10 to 90 mole %.

9. The method according to claim 2, wherein said color developing solution contains bromide in an amount of $1\times10^{-3}$ to $6\times10^{-2}$ mole per liter of color developer.

10. The method according to claim 9, wherein the color developing processing is conducted by use of a color developing solution containing bromide of $1\times10^{-2}$ to $6\times10^{-2}$ mole %.

11. The method according to claim 9, wherein the color developing processing is conducted by use of a color developing solution containing bromide of $1.5\times10^{-2}$ to $6\times10^{-2}$ mole %.

12. The method according to claim 2, wherein said N-hydroxyalkyl-substituted-p-phenylenediamine derivative is 3-methyl-4-amino-N-ethyl-N-β-hydroxyethylaniline salt.

13. The method of claim 2, wherein the amount of silver in the silver halide coated on or contained in the blue-sensitive emulsion layer in the inner latent image type light-sensitive silver halide color photographic material is 0.2 to 0.8 g/m$^2$.

14. The method according to claim 13, wherein the amount of silver in the silver halide coated on or contained in the blue-sensitive emulsion layer is 0.2 to 0.6 g/m$^2$.

15. The method according to claim 5, wherein said film swelling speed $T\frac{1}{2}$ of the binder is 2 to 20 seconds or shorter.

16. The method according to claim 2, wherein the mean grain size of silver halide grains contained at least in a blue-sensitive emulsion layer in the inner latent image type light-sensitive silver halide color photographic material is 0.6 to 1.7 μm.

17. The method according to claim 16, wherein A is

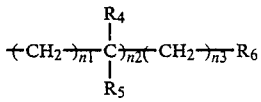

wherein R4, R5 and R6 are each a hydrogen atom, a hydroxyl group, an alkyl group having 1 to 3 carbon atoms or such an alkyl group having a hydroxyl substituent, at least one of $R_4$, $R_5$ and $R_6$ being a hydroxyl group or an alkyl group having a hydroxyl substituent; and $n_1$, $n_2$ and $n_3$ are each 0, 1, 2 or 3.

18. The method according to claim 17, wherein said material is developed in said color developing solution for between 15 and 150 seconds and wherein said silver halide emulsion contains silver bromide in an amount of from 40 to 70 mole %.

19. The method according to claim 6, wherein silver halide grains are contained in at least a blue-sensitive emulsion layer in the inner latent image type light-sensitive silver halide color photographic material and said silver halide grain have a mean grain size of 0.6 to 1.0 μm; the amount of silver contained in said blue-sensitive emulsion layer is 0.2 to 0.6 g/m$^2$ and the film swelling speed T1-2 of a binder is 2 to 20 seconds; said silver halide emulsion contained in at least one light-sensitive emulsion layer is a silver chlorobromide emulsion containing silver bromide in an amount of 40 to 70 mole %; and the developing is carried out for a period of from 15 to 150 seconds with a color developing solution containing bromide in an amount of $1.5\times10^{-2}$ to $6\times10^{-2}$ mole per liter of color developer.

20. The method according to claim 19, wherein A is

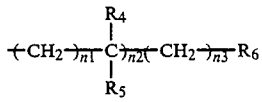

wherein R4, R5 and R6 are each a hydrogen atom, a hydroxyl group, an alkyl group having 1 to 3 carbon atoms or such an alkyl group having a hydroxyl substituent, at least one of $R_4$, $R_5$ and $R_6$ being a hydroxyl group or an alkyl group having a hydroxyl substituent; and $n_1$, $n_2$ and $n_3$ are each 0, 1, 2 or 3.

21. The method according to claim 20, wherein said N-hydroxyalkyl-substituted-p-phenylenediamine derivative is 3-methyl-4-amino-N-ethyl-N-β-hydroxyethylaniline salt.

22. The method according to claim 21, wherein said salt is the sulphate monohydrate.

* * * * *